US011069291B2

(12) United States Patent
Gai et al.

(10) Patent No.: US 11,069,291 B2
(45) Date of Patent: Jul. 20, 2021

(54) PIXEL CIRCUIT AND DRIVING METHOD THEREOF, AND DISPLAY PANEL

(71) Applicant: BOE TECHNOLOGY GROUP CO., LTD., Beijing (CN)

(72) Inventors: Cuili Gai, Beijing (CN); Yi Cheng Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 23 days.

(21) Appl. No.: 16/464,510

(22) PCT Filed: Nov. 15, 2018

(86) PCT No.: PCT/CN2018/115674
§ 371 (c)(1),
(2) Date: May 28, 2019

(87) PCT Pub. No.: WO2019/184391
PCT Pub. Date: Oct. 3, 2019

(65) Prior Publication Data

US 2020/0335035 A1 Oct. 22, 2020

(30) Foreign Application Priority Data

Mar. 26, 2018 (CN) ..... 201810253618.7

(51) Int. Cl.
*G09G 3/325* (2016.01)
*G09G 3/3266* (2016.01)
*G09G 3/3283* (2016.01)

(52) U.S. Cl.
CPC ..... *G09G 3/325* (2013.01); *G09G 3/3266* (2013.01); *G09G 3/3283* (2013.01)

(58) Field of Classification Search
CPC ..... G09G 3/3233; G09G 3/3258; G09G 2320/045; G09G 2360/148;
(Continued)

(56) References Cited

U.S. PATENT DOCUMENTS 9,715,851 B1 7/2017 Song et al.
2006/0214893 A1* 9/2006 Tseng ..... G09G 3/3233 345/82
(Continued)

FOREIGN PATENT DOCUMENTS

CN 1833268 A 9/2006
CN 104637440 A 5/2015
(Continued)

OTHER PUBLICATIONS

International Search Report of PCT/CN2018/115674 in Chinese, dated Jan. 22, 2019, with English translation.
(Continued)

*Primary Examiner* — Gerald Johnson
(74) *Attorney, Agent, or Firm* — Collard & Roe, P.C.

(57) ABSTRACT

A pixel circuit and a driving method thereof, and a display panel are provided. The pixel circuit includes a driving circuit, a data writing circuit, a storage circuit, an electrical compensation circuit, an optical compensation circuit. The driving circuit controls a driving current that drives a light emitting element to emit light. The data writing circuit writes a data signal to a control terminal of the driving circuit in response to a scanning signal. The storage circuit is used for storing the data signal. The electrical compensation circuit electrically connects the second terminal of the driving circuit to a first detecting terminal in response to an electrical detection enable signal. The optical compensation circuit applies an electrical signal generated according to the light emitted from the light emitting element to the second detecting terminal in response to an optical detection enable signal.

19 Claims, 9 Drawing Sheets

(58) Field of Classification Search
CPC ..... G09G 2320/029; G09G 2360/14; G09G 2360/142; G09G 2320/0626; G09G 2320/0295; G09G 3/325; G09G 3/3241; G09G 3/3291; G09G 2310/0256; G09G 3/3283
See application file for complete search history.

(56) References Cited

U.S. PATENT DOCUMENTS

| | | | | |
|---|---|---|---|---|
| 2009/0243498 | A1 | 10/2009 | Childs et al. | |
| 2011/0164010 | A1* | 7/2011 | Yamamoto | G09G 3/3233 345/207 |
| 2011/0191042 | A1* | 8/2011 | Chaji | G09G 3/3258 702/64 |
| 2014/0152633 | A1* | 6/2014 | Park | G09G 3/3291 345/207 |
| 2015/0123953 | A1 | 5/2015 | Shim et al. | |
| 2015/0349129 | A1* | 12/2015 | Ikeda | H01L 27/14632 257/43 |
| 2016/0225316 | A1* | 8/2016 | Chaji | G09G 3/3233 |
| 2017/0162125 | A1 | 6/2017 | Liang | |
| 2017/0169767 | A1 | 6/2017 | Song | |
| 2017/0200411 | A1 | 7/2017 | Song et al. | |
| 2019/0147801 | A1 | 5/2019 | Chu et al. | |
| 2019/0172394 | A1 | 6/2019 | Wang et al. | |
| 2019/0318684 | A1 | 10/2019 | Gai et al. | |

FOREIGN PATENT DOCUMENTS

| | | | |
|---|---|---|---|
| CN | 104809986 | A | 7/2015 |
| CN | 105047137 | A | 11/2015 |
| CN | 105070738 | A | 11/2015 |
| CN | 107731171 | A | 2/2018 |
| CN | 107749280 | A | 3/2018 |
| CN | 107799066 | A | 3/2018 |
| CN | 108428721 | A | 8/2018 |
| CN | 108492765 | A | 9/2018 |
| CN | 108538255 | A | 9/2018 |
| CN | 108831912 | A | 11/2018 |
| JP | 2002169511 | A | 6/2002 |

OTHER PUBLICATIONS

Notice of Transmittal of the International Search Report of PCT/CN2018/115674 in Chinese, dated Jan. 22, 2019.
Written Opinion of the International Searching Authority of PCT/CN2018/115674 in Chinese, dated Jan. 22, 2019 with English translation.
Chinese Office Action in Chinese Application No. 201810253618.7, dated May 27, 2020, with English translation.

* cited by examiner

PIXEL CIRCUIT AND DRIVING METHOD THEREOF, AND DISPLAY PANEL

CROSS REFERENCE TO RELATED APPLICATIONS

This application is the National Stage of PCT/CN2018/115674 filed on Nov. 15, 2018, which claims priority under 35 U.S.C. § 119 of Chinese Application No. 201810253618.7 filed on Mar. 26, 2018, the disclosure of which is incorporated by reference.

TECHNICAL FIELD

The embodiments of the present disclosure relate to a pixel circuit, a driving method thereof, and a display panel.

BACKGROUND

Organic Light Emitting Diode (OLED) display devices are gradually gaining widespread attention by human beings due to their advantages such as wide viewing angle, high contrast ratio, fast response speed, and higher brightness and lower driving voltage than inorganic light emitting display devices. Due to the above characteristics, the organic light emitting diode (OLED) may be applied to a device having a display function such as a mobile phone, a display, a notebook computer, a digital camera, an instrument meter, and the like.

A pixel circuit in an OLED display device generally adopts a matrix driving method, and the matrix driving method is divided into an active matrix (AM) driving and a passive matrix (PM) driving according to whether or not a switching component is included in each pixel unit. Although PMOLED has simple process and low cost, PMOLED cannot meet requirements of high-resolution and large-size display due to the shortcomings such as crosstalk, high power consumption and short life. In contrast, AMOLED integrates a set of thin film transistors and storage capacitors in the pixel circuit of each pixel. Through the driving control of the thin film transistors and the storage capacitors, a current flowing through the OLED is controlled, so that the OLED emits light as needed. Compared with PMOLED, AMOLED requires a less drive current, has lower power consumption and longer life, and can meet the requirements of large-size display with high resolution and multiple gray scales. Meanwhile, AMOLED has obvious advantages in terms of viewing angle, color restoration, power consumption and response time, and is suitable for display devices with high information content and high resolution.

SUMMARY

At least one embodiment of the present disclosure provides a pixel circuit comprising a driving circuit, a data writing circuit, a storage circuit, an electrical compensation circuit, and an optical compensation circuit, the driving circuit comprises a control terminal, a first terminal and a second terminal, and is configured to control a driving current for driving a light emitting element to emit light, the first terminal of the driving circuit is configured to receive a first voltage signal from a first voltage terminal; the data writing circuit is connected to the control terminal of the driving circuit, and is configured to write a data signal into the control terminal of the driving circuit in response to a scanning signal; the storage circuit is configured to store the data signal written by the data writing circuit, a first terminal of the storage circuit is connected to the control terminal of the driving circuit, and a second terminal of the storage circuit is connected to the second terminal of the driving circuit; the electrical compensation circuit is connected to the second terminal of the driving circuit, and is configured to electrically connect the second terminal of the driving circuit to a first detecting terminal in response to an electrical detection enable signal; and the optical compensation circuit is configured to detect light emitted by the light emitting element in response to an optical detection enable signal, and apply an electrical signal, which is generated according to the light emitted by the light emitting element, to a second detecting terminal.

For example, in a pixel circuit provided by an embodiment of the present disclosure, the electrical compensation circuit comprises a first transistor; a gate electrode of the first transistor is configured to be connected to an electrical detection enable line to receive the electrical detection enable signal, a first electrode of the first transistor is configured to be connected to the second terminal of the driving circuit, and a second electrode of the first transistor is configured to be connected to the first detecting terminal.

For example, in a pixel circuit provided by an embodiment of the present disclosure, the optical compensation circuit comprises a photoelectric conversion element and a second transistor; a first terminal of the photoelectric conversion element is configured to be connected to a reverse bias voltage terminal to receive a reverse bias voltage signal, and a second terminal of the photoelectric conversion element is configured to be connected to a first electrode of the second transistor; and a gate electrode of the second transistor is configured to be connected to an optical detection enable line to receive the optical detection enable signal, and a second electrode of the second transistor is configured to be connected to the second detecting terminal.

For example, in a pixel circuit provided by an embodiment of the present disclosure, the driving circuit comprises a third transistor; a gate electrode of the third transistor serves as the control terminal of the driving circuit, a first electrode of the third transistor serves as the first terminal of the driving circuit, and a second electrode of the third transistor serves as the second terminal of the driving circuit.

For example, in a pixel circuit provided by an embodiment of the present disclosure, the data writing circuit comprises a fourth transistor; a gate electrode of the fourth transistor is configured to be connected to a scan line to receive the scanning signal, a first electrode of the fourth transistor is configured to be connected to a data line to receive the data signal, and a second electrode of the fourth transistor is configured to be connected to the control terminal of the driving circuit.

For example, in a pixel circuit provided by an embodiment of the present disclosure, the storage circuit comprises a first capacitor; a first electrode of the first capacitor serves as the first terminal of the storage circuit, and a second electrode of the first capacitor serves as the second terminal of the storage circuit.

For example, a pixel circuit provided by an embodiment of the present disclosure comprises a reset circuit; the reset circuit is connected to the control terminal of the driving circuit, and is configured to apply a reset voltage to the control terminal of the driving circuit in response to a reset signal.

For example, in a pixel circuit provided by an embodiment of the present disclosure, the reset circuit comprises a fifth transistor; a gate electrode of the fifth transistor is configured to be connected to a reset line to receive the reset signal, a first electrode of the fifth transistor is configured to be connected to the control terminal of the driving circuit, and a second electrode of the fifth transistor is configured to be connected to a second voltage terminal to receive the reset voltage.

For example, in a pixel circuit provided by an embodiment of the present disclosure, the electrical compensation circuit and the data writing circuit are connected to a same signal line to respectively receive the electrical detection enable signal and the scanning signal.

For example, in a pixel circuit provided by an embodiment of the present disclosure, the reverse bias voltage terminal and the first detecting terminal are connected to a same signal line.

At least one embodiment of the present disclosure also provides a display panel comprising a plurality of pixel units arranged in an array, each of the plurality of pixel units comprises the pixel circuit according to any of the embodiments of the present disclosure and a light emitting element.

For example, in a display panel provided by an embodiment of the present disclosure, the plurality of pixel units are arranged in a plurality of rows and a plurality of columns, pixel circuits of pixel units in a same row are connected to a same signal line to receive a same electrical detection enable signal and/or a same optical detection enable signal.

For example, in a display panel provided by an embodiment of the present disclosure, the plurality of pixel units are arranged in a plurality of rows and a plurality of columns, first detecting terminals of pixel circuits of pixel units in a same column are electrically connected to each other, and/or second detecting terminals of pixel circuits of pixel units in a same column are electrically connected to each other.

For example, in a display panel provided by an embodiment of the present disclosure, a first terminal of the light emitting element is connected to the second terminal of the driving circuit, a second terminal of the light emitting element is configured to receive a second voltage signal of a second voltage terminal, and the light emitting element is configured to emit light according to the driving current.

At least one embodiment of the present disclosure further provides a driving method of a pixel circuit according to any one of the embodiments of the present disclosure, a the driving method comprises an electrical detection step and an optical detection step; in the electrical detection step, writing data into the driving circuit, and electrically connecting the second terminal of the driving circuit to the first detecting terminal by the electrical compensation circuit; in the optical detection step, the optical compensation circuit generating the electrical signal according to the light emitted by the light emitting element, and applying the electrical signal to the second detecting terminal.

For example, in a driving method of a pixel circuit provided by an embodiment of the present disclosure, the electrical detection step comprises a detection data writing phase and an electrical detection phase; in the detection data writing phase, the scanning signal and the data signal are input to turn on the data writing circuit and the driving circuit, the data writing circuit writes the data signal into the driving circuit, the storage circuit stores the data signal, and the first detecting terminal provides a second voltage signal; in the electrical detection phase, the electrical detection enable signal is input to turn on the electrical compensation circuit, and the electrical compensation circuit electrically connects the second terminal of the driving circuit to the first detecting terminal, and the first detecting terminal is in a floating state.

For example, in a driving method of a pixel circuit provided by an embodiment of the present disclosure, in a case where the electrical detection enable signal and the scanning signal are a same signal, the electrical detection phase further comprises: inputting the scanning signal and the data signal to turn on the data writing circuit and the driving circuit, writing the data signal into the driving circuit by the data writing circuit, and storing the data signal by the storage circuit.

For example, in a driving method of a pixel circuit provided by an embodiment of the present disclosure, the optical detection step comprises an optical detection phase; in the optical detection phase, the optical detection enable signal is input to turn on the optical compensation circuit, the optical compensation circuit generates the electrical signal according to the light emitted by the light emitting element and applies the electrical signal to the second detecting terminal, and the first detecting terminal provides a second voltage signal.

For example, in a driving method of a pixel circuit provided by an embodiment of the present disclosure, the electrical detection step is performed during a blanking time of a scanning timing.

For example, in a driving method of a pixel circuit provided by an embodiment of the present disclosure, the electrical detection step is performed once every display time of N image frame, the optical detection step is performed before each shutdown, and N is an integer greater than zero.

For example, in a driving method of a pixel circuit provided by an embodiment of the present disclosure, the electrical detection step is performed once every display time of N image frame, the optical detection step is performed at a preset display time, and N is an integer greater than zero.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1:
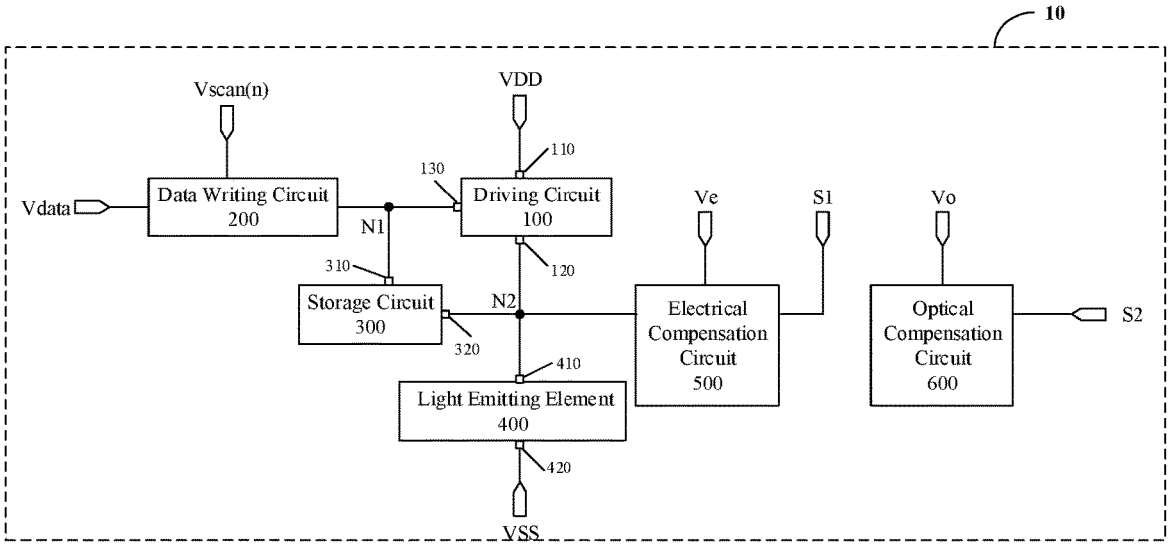
FIG. 1 is a schematic block diagram of a pixel circuit provided by an embodiment of the present disclosure.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art may obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The process stability of a transistor in a pixel circuit is a major factor affecting a display image of a display panel. Because threshold voltages and mobility of driving transistors in a plurality of pixel circuits are different, resulting in that currents supplied to light emitting elements of the respective pixels are different, so that the actual brightness of each pixel is deviated from the desired ideal brightness, thereby affecting the brightness uniformity of the display screen, and even generating a regional spot or pattern. Moreover, factors such as voltage drop of a voltage source (IR Drop) and aging of the OLED also affect the brightness uniformity of the display screen. Therefore, compensation methods are needed to make the brightness of the pixel reach a desired brightness value. The compensation methods may include electrical compensation and optical compensation depending on the manner of data extraction. The electrical compensation and the optical compensation each has different advantages and disadvantages, and independent compensation effects of each of the electrical compensation and the optical compensation are limited and improvement effects on the display brightness uniformity are limited.

At least one embodiment of the present disclosure provides a pixel circuit and a driving method thereof, and a display panel. By combining the electrical compensation and the optical compensation, a difference in brightness of respective regions of the display panel can be compensated for, so as to improve the uniformity of the display brightness of the display panel and the display effect of the display panel, and achieve real-time compensation.

Hereinafter, embodiments of the present disclosure will be described in detail with reference to the accompanying drawings. It should be noted that the same reference numerals will be used in the different drawings to refer to the same elements that have been described.

At least one embodiment of the present disclosure provides a pixel circuit, and the pixel circuit includes a driving circuit, a data writing circuit, a storage circuit, an electrical compensation circuit, and an optical compensation circuit. The driving circuit includes a control terminal, a first terminal and a second terminal, and is configured to control a driving current for driving a light emitting element to emit light, the first terminal of the driving circuit is configured to receive a first voltage signal from a first voltage terminal; the data writing circuit is connected to the control terminal of the driving circuit, and is configured to write a data signal into the control terminal of the driving circuit in response to a scanning signal; a first terminal of the storage circuit is connected to the control terminal of the driving circuit, a second terminal of the storage circuit is connected to the second terminal of the driving circuit, and the storage circuit is configured to store the data signal written by the data writing circuit; the electrical compensation circuit is connected to the second terminal of the driving circuit, and is configured to electrically connect the second terminal of the driving circuit to a first detecting terminal in response to an electrical detection enable signal; the optical compensation circuit is configured to detect light emitted by a light emitting element in response to an optical detection enable signal, and apply an electrical signal, which is generated according to the light emitted by the light emitting element, to a second detecting terminal.

FIG. 1 is a schematic block diagram of a pixel circuit provided by an embodiment of the present disclosure. Referring to FIG. 1, the pixel circuit 10 includes a driving circuit 100, a data writing circuit 200, a storage circuit 300, an electrical compensation circuit 500, and an optical compensation circuit 600. The pixel circuit 10 is, for example, used to drive a light emitting element 400 in a sub-pixel of an OLED display device to emit light. In at least one embodiment of the present disclosure, a display panel of the display device is prepared, for example, by a glass substrate, and a specific structure and a preparation process of the display panel may adopt conventional methods in the art, which will not be described in detail herein, and the embodiments of the present disclosure are not limited thereto.

For example, the driving circuit 100 includes a first terminal 110, a second terminal 120, and a control terminal 130, and is configured to control a driving current for driving the light emitting element 400 to emit light. The control terminal 130 of the driving circuit 100 is connected to a first node N1, and the first terminal 110 of the driving circuit 100 is connected to a first voltage terminal VDD (for example, a high level) to receive a first voltage signal, and the second terminal 120 of the driving circuit 100 is connected to a second node N2. For example, the driving circuit 100 may provide the driving current to the light emitting element 400 to drive the light emitting element 400 to emit light when the driving circuit 100 is in operation, so as to make the light emitting element 400 emit light according to a required "gray scale". For example, the light emitting element 400 may employ an OLED or a QLED (Quantum Dot Light Emitting Diodes), or the like, and is configured such that two terminals of the light emitting element 400 are respectively connected to a second node N2 and a second voltage terminal VSS (for example, ground). Embodiments of the present disclosure include, but are not limited thereto. Correspondingly, the display panel is an OLED display panel or a QLED display panel. Hereinafter, a case that the light emitting element is the OLED is taken as an example to describe the embodiments of the present disclosure, and the corresponding description is also applicable to the QLED.

For example, the data writing circuit 200 is connected to the control terminal 130 (first node N1) of the driving circuit 100, and is configured to write a data signal into the control terminal 130 of the driving circuit 100 in response to a scanning signal. For example, the data writing circuit 200 is connected to a data line (data signal terminal Vdata), the first node N1, and a scan line (scanning signal terminal Vscan(n)), respectively. For example, a scanning signal from the scanning signal terminal Vscan(n) is applied to the data writing circuit 200 to control whether the data writing circuit 200 is turned on or not. For example, in a data writing phase, the data writing circuit 200 may be turned on in response to the scanning signal, so that the data signal may be written into the control terminal 130 (first node N1) of the driving circuit 100, and then the data signal may be stored in the storage circuit 300, the stored data signal will be used to generate a driving current that is used for driving the light emitting element 400 to emit light. For example, the size of the data signal Vdata determines the luminance (i.e., the gray scale used for display) of the pixel unit.

For example, a first terminal 310 of the storage circuit 300 is connected to the control terminal 130 (first node N1) of the driving circuit 100, and a second terminal 320 of the storage circuit 300 is connected to the second terminal 120 (second node N2) of the driving circuit 100. The storage circuit 300 is configured to store the data signal written by the data writing circuit 200. For example, the storage circuit 300 may store the data signal, and cause the stored data signal to control the driving circuit 100.

For example, a first terminal 410 of the light emitting element 400 is connected to the second terminal 120 (second node N2) of the driving circuit 100 to receive the driving current, and a second terminal 420 of the light emitting element 400 is connected to the second voltage terminal VSS to receive a second voltage signal. The light emitting element 400 is configured to emit light according to the driving current from the driving circuit 100.

For example, the electrical compensation circuit 500 is connected to the second terminal 120 (second node N2) of the driving circuit 100, and is configured to electrically connect the second terminal 120 of the driving circuit 100 to a first detecting terminal S1 in response to an electrical detection enable signal. For example, the electrical compensation circuit 500 is connected to the second node N2, an electrical detection enable line (electrical detection enable terminal Ve), and the first detecting terminal S1, respectively. For example, the electrical detection enable signal from the electrical detection enable terminal Ve is applied to the electrical compensation circuit 500 to control whether the electrical compensation circuit 500 is turned on or not. For example, the electrical compensation circuit 500 and the data writing circuit 200 may be connected to the same signal line (e.g., a scan line) to respectively receive the electrical detection enable signal and the scanning signal, that is, the electrical detection enable signal and the scanning signal are the same signal in this case, thereby simplifying the circuit structure. For example, the first detecting terminal S1 is configured to be capable of providing the second voltage signal (e.g., ground) and may be switched to a floating state. For example, in the electrical detection step, when the detection data is written, the first detecting terminal S1 provides the second voltage signal to ensure that the detection data is correctly written. Then, the first detecting terminal S1 is switched to the floating state, and the second terminal 120 of the driving circuit 100 is electrically connected to the first detecting terminal S1, so that the current flowing through the driving circuit 100 can be detected. For example, the current may be converted into a voltage signal by a separately provided detection circuit (for example, an operational amplifier, an analog-to-digital converter, etc.), and then the voltage signal is converted into a digital signal and the signal obtained is stored. The signal may be further processed by an algorithm to obtain electrical compensation data, and then, in a normal light emitting phase of the pixel circuit, the electrical compensation data obtained by the algorithm is superimposed onto the input display data to obtain the compensated display data, and the compensated display data may be written by the data writing circuit 200 to control the conduction degree of the driving circuit 100, so that the brightness difference between different regions of the display panel caused by the difference in threshold voltages and the difference in mobility of the transistors in the driving circuits 100 may be compensated for.

For example, the optical compensation circuit 600 is configured to detect light emitted from the light emitting element 400 in response to an optical detection enable signal, and apply an electrical signal, which is generated according to the light emitted from the light emitting element 400, to a second detecting terminal S2. For example, the optical compensation circuit 600 is connected to an optical detection enable line (optical detection enable terminal Vo) and the second detecting terminal S2, respectively. For example, the optical detection enable signal from the optical detection enable terminal Vo is applied to the optical compensation circuit 600 to control whether the optical compensation circuit 600 is turned on or not. For example, the optical compensation circuit 600 may detect the light emitted from the light emitting element 400 through a photoelectric conversion element such as a photodiode, and the photoelectric conversion element may be disposed in a reverse bias mode so as to perform photoelectric detection. At this time, the optical compensation circuit 600 may also be connected to a reverse bias voltage terminal to receive a reverse bias voltage signal.

For example, the optical compensation circuit 600 may be independent of other circuits in circuit connection relationship, or may share related signals with the other circuits. For example, in a case where the optical compensation circuit 600 detects the light emitted from the light emitting element 400 by connecting the photoelectric conversion elements in a reverse bias mode, the reverse bias voltage terminal and the first detecting terminal S1 may be connected to the same signal line, and when the optical detection is performed, the second voltage signal is provided through the signal line (i.e., the first detecting terminal S1 provides the second voltage signal at this time), which simplifies the circuit structure. For example, an electrical signal generated by the photoelectric conversion element is converted into a digital signal by a separately provided detection circuit (for example, an operational amplifier, an analog-to-digital converter, etc.) and then the digital signal is stored, and the digital signal may be further processed by an algorithm (for example, an optical compensation algorithm) to obtain optical compensation data. In the normal light emitting phase of the pixel circuit, the optical compensation data obtained by the algorithm is superimposed onto the input display data to obtain compensated display data, and the compensated display data can be written by the data writing circuit 200 to control the driving circuit 100, so that the difference in threshold voltage and mobility of the transistors in the driving circuit 100 and the brightness difference between different regions of the display panel caused by factors, such as the difference in threshold voltages and the difference in mobility of the transistors in the driving circuits 100, and aging of the OLED, can be compensated for.

Figure 2:
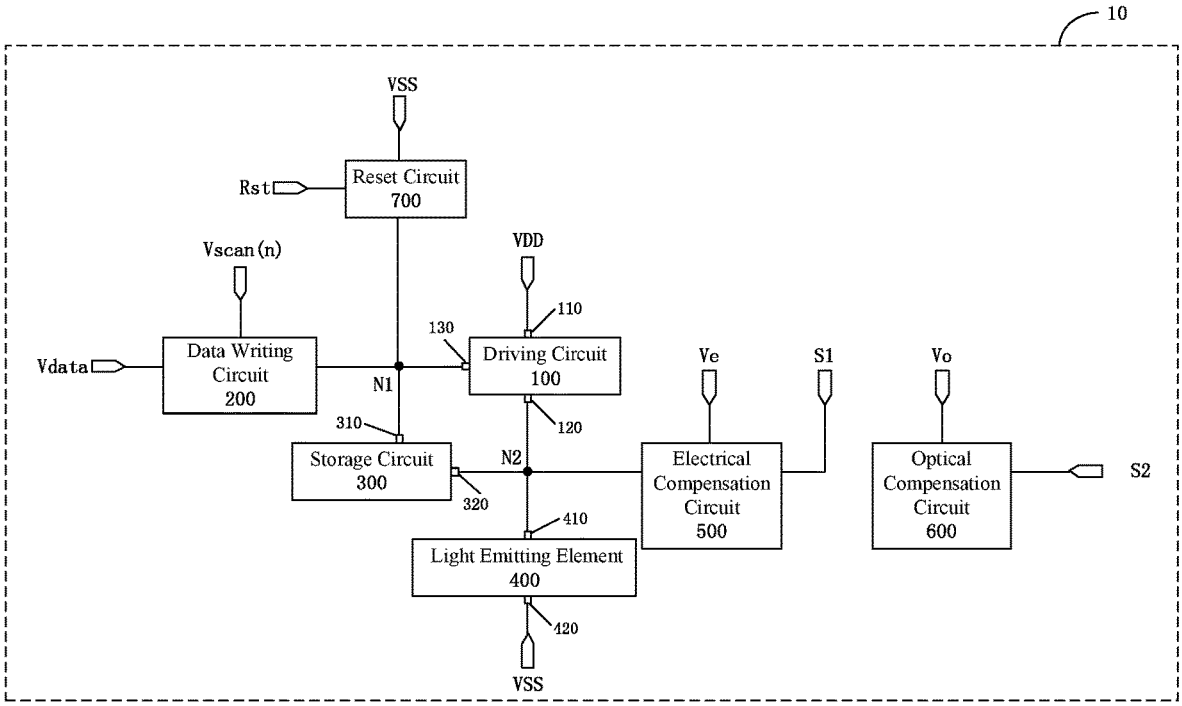
FIG. 2 is a schematic block diagram of another pixel circuit provided by an embodiment of the present disclosure.

FIG. 2 is a schematic block diagram of another pixel circuit provided by an embodiment of the present disclosure. Referring to FIG. 2, the pixel circuit 10 may further include a reset circuit 700. Other structures of the pixel circuit 10 shown in FIG. 2 are substantially the same as those of the pixel circuit 10 shown in FIG. 1, and details are not described herein again. The reset circuit 700 is connected to the control terminal 130 (first node N1) of the driving circuit 100, and is configured to apply a reset voltage to the control terminal 130 of the driving circuit 100 and the first terminal 310 of the storage circuit 300 in response to a reset signal, so that the first node N1 and various components electrically connected thereto are reset. For example, the reset circuit 700 is connected to the first node N1, the second voltage terminal VSS, and a reset line (reset signal terminal Rst), respectively. For example, the reset circuit 700 may be turned on in response to the reset signal, so that the reset voltage (here, the voltage for resetting is the second voltage signal) may be applied to the first node N1, the first terminal 310 of the storage circuit 300, and the control terminal 130 of the driving circuit 100, so as to perform a reset operation on the storage circuit 300 and the driving circuit 100, thereby eliminating the influence of the previous light emitting phase. For example, the reset voltage may be provided by the second voltage terminal VSS, and may also be provided by a reset voltage terminal independent of the second voltage terminal VSS in other embodiments, thereby accordingly, the reset circuit 700 is connected to the reset voltage terminal rather than the second voltage terminal VSS, which is not limited in the embodiments of the present disclosure. For example, the second voltage terminal VSS is a low voltage terminal (lower than the first voltage terminal VDD), for example, a ground terminal.

For example, in the case where the driving circuit 100 is implemented as a driving transistor, for example, a gate electrode of the driving transistor may serve as the control terminal 130 (connected to the first node N1) of the driving circuit 100, a first electrode (e.g., source electrode) of the driving transistor may serve as the first terminal 110 (connected to the first voltage terminal VDD) of the driving circuit 100 and a second electrode (e.g., drain electrode) of the driving transistor may serve as the second terminal 120 (connected to the second node N2) of the driving circuit 100.

It should be noted that, for the purpose of description, the first voltage terminal VDD in each embodiment of the present disclosure, for example, maintains to input a DC high level signal, and the input DC high level signal is referred to as a first voltage; the second voltage terminal VSS for example, maintains to input a DC low level signal, and the DC low level signal is referred to as a second voltage (which can be used as a reset voltage) and is lower than the first voltage. The following embodiments are the same as those described herein and will not be described again.

It should be noted that in the description of the embodiments of the present disclosure, the symbol Vdata may represent both the data signal terminal and the level of the data signal. Similarly, the symbol Rst may represent both the reset signal terminal and the level of the reset signal. The symbol VDD may represent both the first voltage terminal and the first voltage. The symbol VSS may represent both the second voltage terminal and the second voltage. The symbol Ve may represent both the electrical detection enable terminal and the level of the electrical detection enable signal, and the symbol Vo may represent both the optical detection enable terminal and the level of the optical detection enable signal. The following embodiments are the same as those described herein and will not be described again.

It should be noted that the pixel circuit 10 provided by the embodiments of the present disclosure may further include other circuit structures having an internal compensation function. The internal compensation function may be implemented by voltage compensation, current compensation or hybrid compensation. The pixel circuit 10 having an internal compensation function may be, for example, a combination of a circuit such as 4T1C or 4T2C, the electrical compensation circuit 500 and the optical compensation circuit 600. For example, in the pixel circuit 10 having an internal compensation function, the data writing circuit 200 and the internal compensation circuit cooperate to write a voltage value carrying the data signal and the threshold voltage information of the driving transistor in the driving circuit 100 to the control terminal 130 of the driving circuit 100 and store the voltage value through the storage circuit 300. Examples of specific internal compensation circuits are not described in detail herein.

The pixel circuit 10 provided by the embodiment of the present disclosure combines electrical compensation and optical compensation, which can greatly compensate the brightness difference of the display screen of the display panel, improve the display effect, and achieve real-time compensation.

Figure 3:
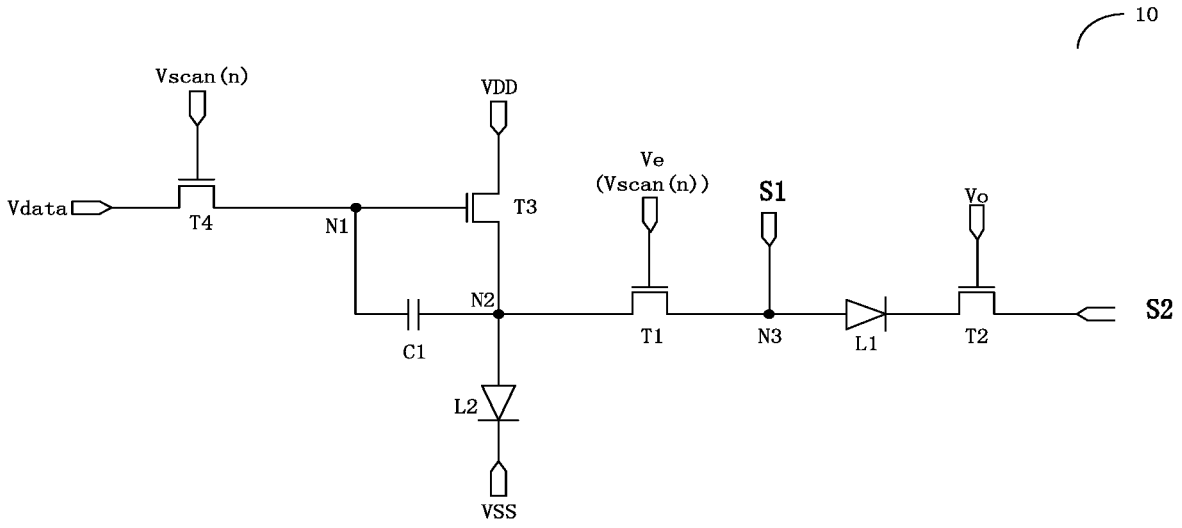
FIG. 3 is a circuit diagram showing a specific implementation example of the pixel circuit shown in FIG. 1.

FIG. 3 is a circuit diagram showing a specific implementation example of the pixel circuit shown in FIG. 1. Referring to FIG. 3, the pixel circuit 10 includes first to fourth transistors T1, T2, T3, and T4 and includes a first capacitor C1, a photoelectric conversion element L1, and a light emitting element L2. For example, the third transistor T3 is used as a driving transistor, and the other transistors are used as switching transistors. For example, the light emitting element L2 may be various types of OLEDs, such as top-emitting OLEDs, bottom-emitting OLEDs, double-sided emitting OLEDs, etc., and may emit red light, green light, blue light, or white light, etc., which is not limited in the embodiments of the present disclosure.

For example, as shown in FIG. 3, in more detail, the electrical compensation circuit 500 may be implemented as the first transistor T1. A gate electrode of the first transistor T1 is configured to be connected to the electrical detection enable line (electrical detection enable terminal Ve) to receive the electrical detection enable signal, and the first electrode of the first transistor T1 is configured to be connected to the second terminal 120 (second node N2) of the driving circuit 100, and a second electrode of the first transistor T1 is configured to be connected to the first detecting terminal S1 (third node N3). For example, the electrical detection enable line (electrical detection enable terminal Ve) is connected to the scan line (scanning signal terminal Vscan(n)), that is, the electrical detection enable signal and the scanning signal are the same signal in this case, which simplifies the circuit structure. Here (n) denotes, for example, the $n_{th}$ row of pixels in the pixel array. It should be noted that, the present disclosure is not limited thereto, the electrical compensation circuit 500 may be a circuit composed of other components.

The optical compensation circuit 600 may be implemented as the photoelectric conversion element L1 and the second transistor T2. In a different example, the photoelectric conversion element L1 may be, for example, a photodiode, a photo transistor, or the like. For example, in a case where the photoelectric conversion element L1 is a photodiode or the like, the photoelectric conversion element L1 may be in a reverse bias (reverse bias) state, and a first terminal of the photoelectric conversion element L1 is configured to be connected to the reverse bias voltage terminal (here, connected to the first detecting terminal S1) to receive the reverse bias voltage signal (i.e., the second voltage signal), a second terminal of the photoelectric conversion element L1 is configured to be connected to a first electrode of the second transistor T2. The first detecting terminal S1 is multiplexed into the reverse bias voltage terminal, that is, the first detecting terminal S1 and the reverse bias voltage terminal are connected to the same signal line, which can simplify the circuit structure. A gate electrode of the second transistor T2 is configured to be connected to the optical detection enable line (optical detection enable terminal Vo) to receive an optical detection enable signal, and a second electrode of the second transistor T2 is configured to be connected to the second detecting terminal S2. It should be noted that, the present disclosure is not limited thereto, the optical compensation circuit 600 may also be a circuit composed of other components.

The driving circuit 100 may be implemented as a third transistor T3. A gate electrode of the third transistor T3 serves as the control terminal 130 of the driving circuit 100 and is connected to the first node N1, a first electrode of the third transistor T3 serves as the first terminal 110 of the driving circuit 100 and is connected to the first voltage terminal VDD, and a second electrode of the third transistor T3 serves as the second terminal 120 of the driving circuit 100 and is connected to the second node N2. It should be noted that, the present disclosure is not limited thereto, the driving circuit 100 may be a circuit composed of other components. For example, the driving circuit 100 may have two sets of driving transistors. For example, the two sets of driving transistors may be switched according to specific conditions.

The data writing circuit 200 may be implemented as the fourth transistor T4. A gate electrode of the fourth transistor T4 is configured to be connected to the scan line (scanning signal terminal Vscan(n)) to receive the scanning signal, a first electrode of the fourth transistor T4 is configured to be connected to a data line (data signal terminal Vdata) to receive the data signal, and a second electrode of the fourth transistor T4 is configured to be connected to the control terminal 130 (first node N1) of the driving circuit 100. It should be noted that, the present disclosure is not limited thereto, the data writing circuit 200 may also be a circuit composed of other components.

The storage circuit 300 may be implemented as the first capacitor C1. A first electrode of the first capacitor C1 serves as the first terminal 310 of the storage circuit 300 and is configured to be connected to the first node N1, and a second electrode of the first capacitor C1 serves as the second terminal 320 of the storage circuit 300 and is configured to be connected to the second node N2. It should be noted that, the present disclosure is not limited thereto, the storage circuit 300 may also be a circuit composed of other components. For example, the storage circuit 300 may include two capacitors connected in parallel/series.

The light emitting element 400 may be implemented as the light emitting element L2 (e.g., an OLED). A first terminal (here, an anode) of the light emitting element L2 serves as a first terminal 410 of the light emitting element 400 and is configured to be connected to the second node N2 and configured to receive a driving current from the second terminal 120 of the driving circuit 100, a second terminal (here, a cathode) of the light emitting elements L2 serves as the second terminal 420 of the light emitting element 400 and is connected to the second voltage terminal VSS to receive the second voltage signal. For example, the second voltage terminal VSS maintains to input a DC low level signal, that is, the second voltage terminal VSS can be at a low level, such as be grounded. For example, in a display panel, when the pixel circuits 10 are arranged in an array, the cathodes of the light emitting elements L2 in the pixel circuits 10 of the respective sub-pixels may be electrically connected to the same voltage terminal, that is, the display panel adopts a common cathode connection manner.

It should be noted that in the description of the present disclosure, the first node N1, the second node N2, and the third node N3 do not represent components that are actually existed, but represent conjunction points of related electrical connections in the circuit diagram.

Figure 4:
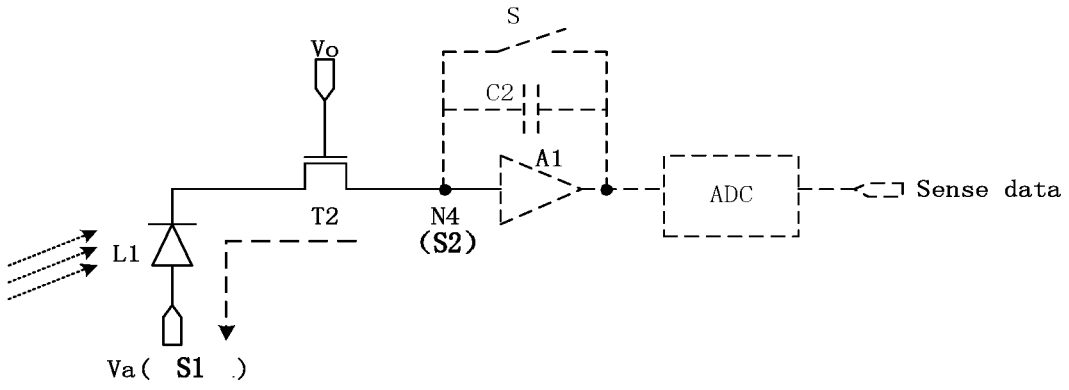
FIG. 4 is a schematic diagram showing an operating principle of the optical compensation circuit in the pixel circuit shown in FIG. 3.

FIG. 4 is a schematic diagram showing an operation principle of the optical compensation circuit in the pixel circuit shown in FIG. 3. Referring to FIG. 4, the photoelectric conversion element L1 is a photodiode and is connected in a reverse bias mode. The reverse bias voltage terminal Va provides a low level signal (for example, the low level signal may be −5V to 0V, and is 0V in this example) to control the photoelectric conversion element L1 to be in a reverse bias state. In this example, the reverse bias voltage terminal Va is the same terminal as the first detecting terminal S1, that is, when optical detection is performed, the first detecting terminal S1 provides a second voltage signal. After the photoelectric conversion element L1 senses the light, the photoelectric conversion element L1 integrates for a certain time and generates charges, the second transistor T2 is turned on under the control of the optical detection enable signal, and the generated charges are transferred to a subsequent detection circuit through the second detecting terminal S2 (fourth node N4) for detection. For example, the subsequent detection circuit includes an amplifying circuit composed of an operational amplifier A1, a feedback capacitor C2, and a switch S, and an analog-to-digital converter ADC, sense data (Sense data) may be obtained through the above circuit, so as to complete optical detection. It should be noted that, the present disclosure is not limited to this, the optical compensation circuit 600 may also be constructed in other manners, and use other applicable detection principles to perform optical detection.

Figure 5:
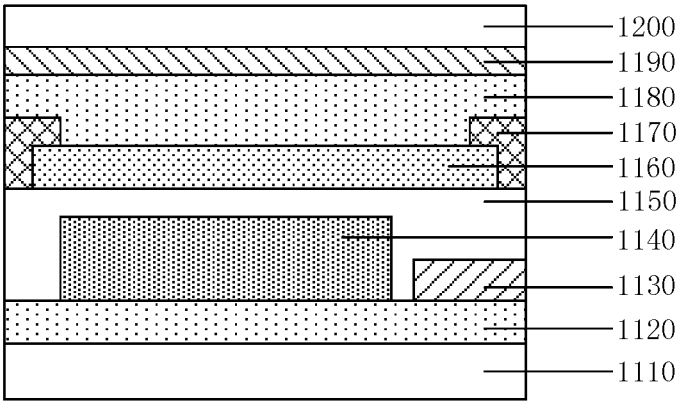
FIG. 5 is a schematic diagram of a stack (layer structure) of a display panel provided by an embodiment of the present disclosure.

FIG. 5 is a schematic diagram of a stack (layer structure) of a display panel provided by an embodiment of the present disclosure, and the display panel includes the pixel circuit 10 described above. Referring to FIG. 5, the display panel is sequentially composed of a first substrate 1110, a pixel circuit layer 1120, a photoelectric conversion element layer 1130, a color film layer 1140, a flat layer 1150, an anode layer 1160, a pixel defining layer 1170, an electroluminescent material layer 1180, a cathode layer 1190 and a second substrate 1200. For example, the thin film transistors and the capacitor in the pixel circuit 10 are located in the pixel circuit layer 1120. The photoelectric conversion element L1 in the pixel circuit 10 is located at the photoelectric conversion element layer 1130. For example, the color film layer 1140 and the photoelectric conversion element layer 1130 are located in the same layer, and the color film layer 1140 is located in a display area such that the light emitted by the display panel presents a desired color, and the photoelectric conversion element layer 1130 is located in a non-display area to avoid affecting the normal display. For example, the display panel is a bottom-emitting mode. Of course, the embodiment of the present disclosure is not limited thereto, and the display panel may also be a top-emitting mode, and the setting position of the color film layer 1140 may be adjusted according to actual needs. For example, the pixel definition layer 1170 has a hollowed out region such that the anode layer 1160 and the electroluminescent material layer 1180 have good electrical contact in the hollowed out region. The specific features of each part of the display panel are similar to those of a normal display panel, and will not be described in detail herein. It should be noted that, in various embodiments of the present disclosure, the display panel may include more or less structures or components, and the relative positional relationship among the respective structures or components may be determined according to actual needs, the embodiments of the present disclosure are not limited thereto.

Figure 6:
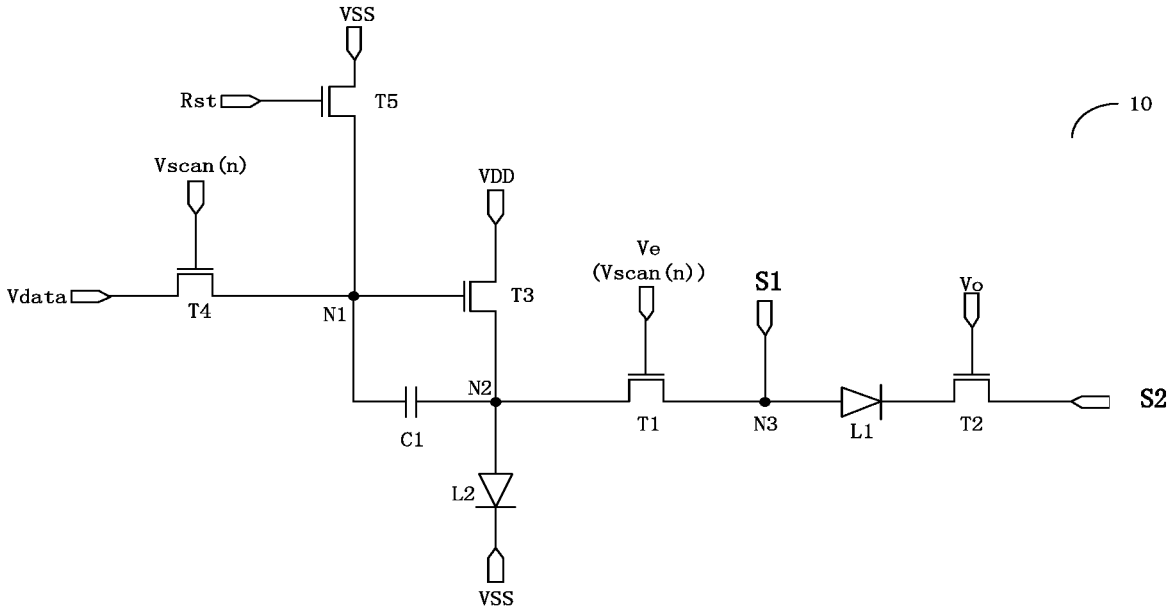
FIG. 6 is a circuit diagram showing a specific implementation example of the pixel circuit shown in FIG. 2.

FIG. 6 is a circuit diagram showing a specific implementation example of the pixel circuit shown in FIG. 2. The pixel circuit 10 shown in FIG. 6 is substantially the same as the pixel circuit 10 shown in FIG. 3, except that the pixel circuit 10 shown in FIG. 6 further includes a fifth transistor T5 to implement the reset circuit 700.

For example, as shown in FIG. 6, in more detail, the reset circuit 700 may be implemented as the fifth transistor T5. A gate electrode of the fifth transistor T5 is configured to be connected to a reset line (reset signal terminal Rst) to receive a reset signal, and a first electrode of the fifth transistor T5 is configured to be connected to a second voltage terminal VSS to receive a second voltage signal (which may be used as a reset voltage), a second electrode of the fifth transistor T5 is configured to be connected to the control terminal 130 (first node N1) of the driving circuit 100. It should be noted that, the present disclosure is not limited thereto, the reset circuit 700 may also be a circuit composed of other components.

Figure 7:
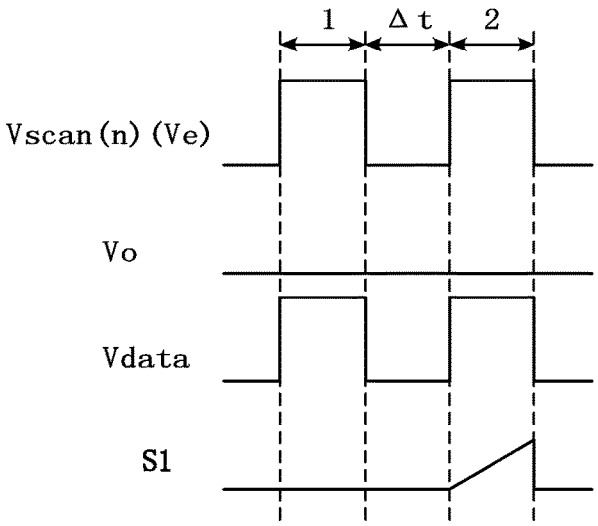
FIG. 7 is a timing diagram of an electrical detection step of a pixel circuit provided by an embodiment of the present disclosure.

FIG. 7 is a timing diagram of an electrical detection step of a pixel circuit provided by an embodiment of the present disclosure. The operation principle of the pixel circuit 10 shown in FIG. 3 in the electrical detection step will be described below with reference to the signal timing diagram shown in FIG. 7. Here, the description will be made by taking a case that each transistor is an N-type transistor as an example, but the embodiment of the present disclosure is not limited to this. For example, the N-type transistor is turned on in response to a high-level signal and is turned off in response to a low-level signal, and the following embodiments are the same as those described herein, and will not be described again.

In the electrical detection step, data is written into the driving circuit 100 and the second terminal 120 of the driving circuit 100 is electrically connected to the first detecting terminal S1 by an electrical compensation circuit 500. As shown in FIG. 7, the electrical detection step includes two phases, which are a detection data writing phase 1 and an electrical detection phase 2, respectively, and a timing waveform of each signal in each phase is shown in FIG. 7.

Figure 8A:
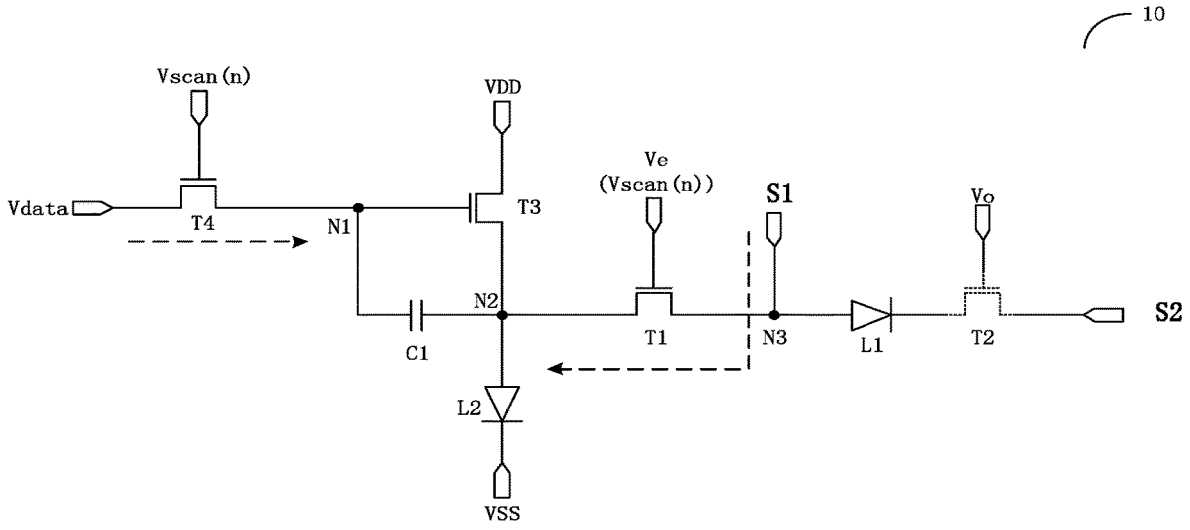
FIGS. 8A to 8B are circuit schematic diagrams of the pixel circuit shown in FIG. 3 corresponding to two phases in FIG. 7.
Figure 8B:
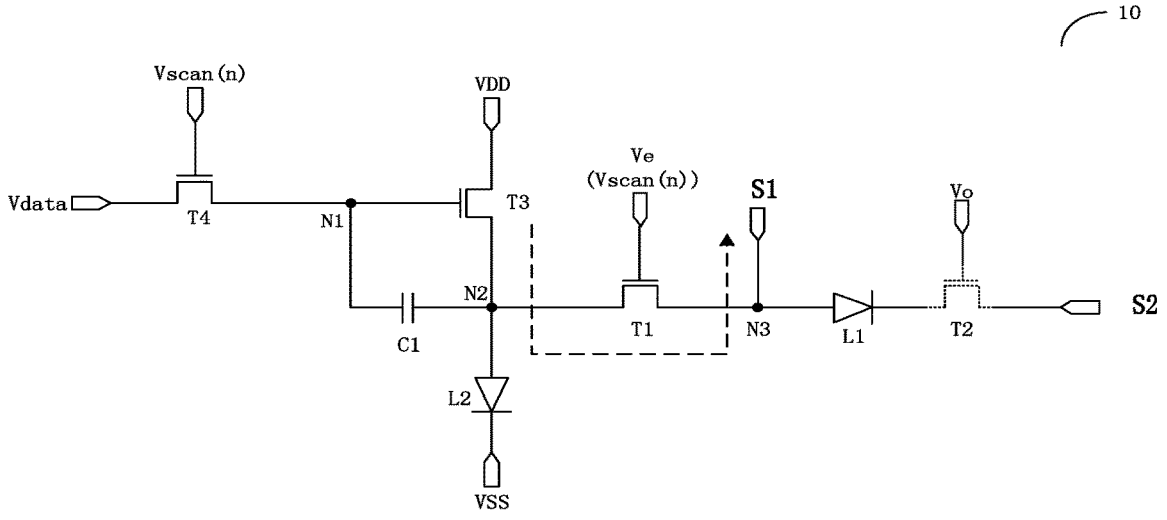

It should be noted that FIG. 8A to FIG. 8B are schematic diagrams of the pixel circuit 10 shown in FIG. 3 in the above two phases, respectively. FIG. 8A is a schematic diagram of the pixel circuit 10 shown in FIG. 3 in the detection data writing phase 1, and FIG. 8B is a schematic diagram of the pixel circuit 10 shown in FIG. 3 in the electrical detection phase 2.

In addition, the transistors identified by dashed lines in FIGS. 8A to 8B are in an off state in the corresponding phase, and the dashed lines with arrows in FIGS. 8A to 8B indicate a current direction of the pixel circuit in the corresponding phase. The transistors shown in FIGS. 8A to 8B are all described by taking an N-type transistor as an example, that is, the respective transistors are turned on in a case where the gate electrodes of the respective transistors are connected to a turn-on level (a high level), and the respective transistors are turned off in a case where the gate electrodes of the respective transistors are connected to a turn-off level (a low level). The following embodiments are the same as those described herein and will not be described again.

In the detection data writing phase 1, the scanning signal (provided by the scanning signal terminal Vscan(n)) and the data signal (provided by the data signal terminal Vdata) are input to turn on the data writing circuit 200 and the driving circuit 100, the data signal is written into the driving circuit 100 by the data writing circuit 200 and stored by the storage circuit 300, and the second voltage signal is provided by the first detecting terminal S1.

As shown in FIG. 7 and FIG. 8A, in the detection data writing phase 1, the fourth transistor T4 is turned on by the high level of the scanning signal, the third transistor T3 is turned on by the high level of the first node N1, and the first transistor T1 is turned on by the high level of the electrical detection enable signal (scanning signal); meanwhile, the second transistor T2 is turned off by the low level of the optical detection enable signal.

As shown in FIG. 8A, in the detection data writing phase 1, a data writing path is formed (shown by a dashed line with an arrow in FIG. 8A), and the data signal charges the first capacitor C1 after passing through the fourth transistor T4. At this time, the first detecting terminal S1 provides the second voltage signal, that is, a level of the second node N2 is a second voltage.

After the detection data writing phase 1, the voltage information with the data signal is stored in the first capacitor C1 to facilitate electrical detection in the next stage.

In the electrical detection phase 2, the electrical detection enable signal (i.e., the scanning signal provided by the scanning signal terminal Vscan(n)) is input to turn on the electrical compensation circuit 500, and the electrical compensation circuit 500 electrically connects the second terminal 120 of the driving circuit 100 to the first detecting terminal S1, and the first detecting terminal is in a floating state.

As shown in FIG. 7 and FIG. 8B, in the electrical detection phase 2, the fourth transistor T4 is turned on by the high level of the scanning signal, and the third transistor T3 is turned on by the high level of the first node N1, and the first transistor T1 is turned on by the high level of the electrical detection enable signal (scanning signal); meanwhile, the second transistor T2 is turned off by the low level of the optical detection enable signal.

As shown in FIG. 8B, in the electrical detection phase 2, a current transmission path is formed (shown by a dashed line with an arrow in FIG. 8B), and the current flowing through the third transistor T3 is transmitted to the first detecting terminal S1 via the first transistor T1 and is processed by the subsequent detection circuit. At this time, the first detecting terminal S1 is in a floating state. Because the resistance of the first detecting terminal S1 is much smaller than the resistance of the light emitting element L2, there is no current or substantially no current in the light emitting element L2, and the light emitting element L2 does not emit light.

After the electrical detection phase 2, the current flowing through the third transistor T3 is converted into a voltage signal after being processed by the subsequent detection circuit (for example, an operational amplifier, an analog-to-digital converter, etc.), and the voltage signal is then converted into a digital signal and the digital signal obtained is stored, and the digital signal is further processed by an algorithm to obtain electrical compensation data. Then, in the normal light emitting phase of the pixel circuit 10, the electrical compensation data obtained by the algorithm is superimposed on the input display data to obtain the compensated display data, and the compensated display data can be written by the data writing circuit 200 to control the driving circuit 100, so that the difference in uniformity of display brightness caused by the difference in the threshold voltages and the difference in mobility of the transistor (third transistor T3) in the driving circuit 100 can be compensated for. The subsequent detection circuit is not included in the pixel circuit 10, and may be implemented by using a conventional circuit structure, and therefore will not be described in detail.

It should be noted that there is an interval time Δt between the detection data writing phase 1 and the electrical detection phase 2, and the specific size of the interval time Δt is not limited. For example, when the interval time Δt=0, the timing sequence of the detection data writing phase 1 and the timing sequence of the electrical detection phase 2 are linked together.

In the case where the electrical detection enable signal and the scanning signal are the same signal, in the electrical detection phase 2, an effective data signal is still maintained to prevent the first capacitor C1 from leaking and affecting the on/off degree of the third transistor T3, thereby avoiding affecting the accuracy of the detected data.

Figure 9:
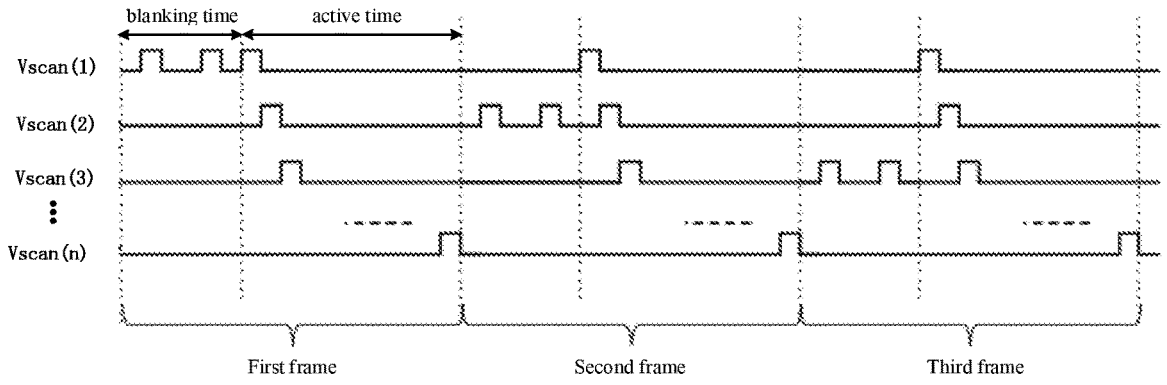
FIG. 9 is a scanning timing diagram of a pixel circuit provided by an embodiment of the present disclosure.

FIG. 9 is a scanning timing diagram of a pixel circuit provided by an embodiment of the present disclosure. Referring to FIG. 9, the scanning timing of each frame image includes a blanking time and an active time (Active Area). During the active time, the pixel circuits of the pixel array are scanned line by line to display an image, and the operation of the pixel circuit may be seen in the subsequent FIGS. 11A and 11B. During the blanking time, the pixel circuits do not perform a scanning operation. For example, the electrical detection step is performed during blanking time to avoid affecting the normal display of the image. For example, the electrical detection step is performed once every display time of N image frame, and N is an integer greater than zero. The number of performing times and the time of the electrical detection step may be determined according to specific needs, and embodiments of the present disclosure do not limit this.

Figure 10:
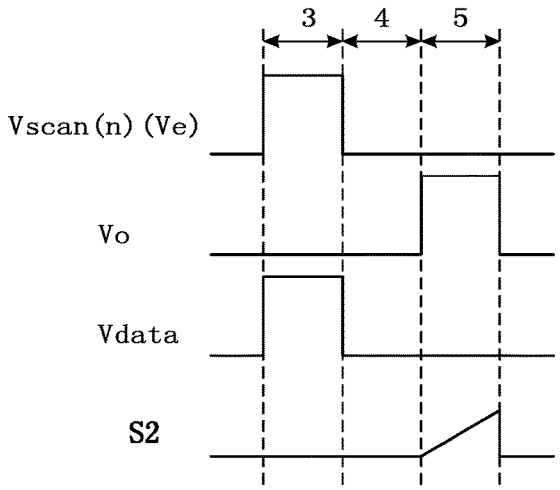
FIG. 10 is a timing diagram of an optical detection step of a pixel circuit provided by an embodiment of the present disclosure.

FIG. 10 is a timing diagram of an optical detection step of a pixel circuit provided by an embodiment of the present disclosure. The operation principle of the pixel circuit 10 shown in FIG. 3 in the optical detection step will be described below with reference to the signal timing diagram shown in FIG. 10, and here the description will be made by taking a case that each transistor is an N-type transistor as an example, but the embodiment of the present disclosure is not limited thereto.

In the optical detection step, the optical compensation circuit 600 generates an electrical signal according to the light emitted from the light emitting element 400, and applies the electrical signal to the second detecting terminal S2. As shown in FIG. 10, the optical detection step includes a phase, that is, an optical detection phase 5. The timing shown in FIG. 10 also includes a display data writing phase 3 for normally displaying an image and a light emitting phase 4. The optical detection phase 5 is closely connected with the display data writing phase 3 and the light emitting phase 4 in time, and may detect the light emitted by each pixel when the image is normally displayed, so that the normal display of the image is not affected when the optical detection is performed, which is advantageous for improving the detection efficiency. The timing waveforms of the respective signals in each of the above phases are shown in FIG. 10.

Figure 11A:
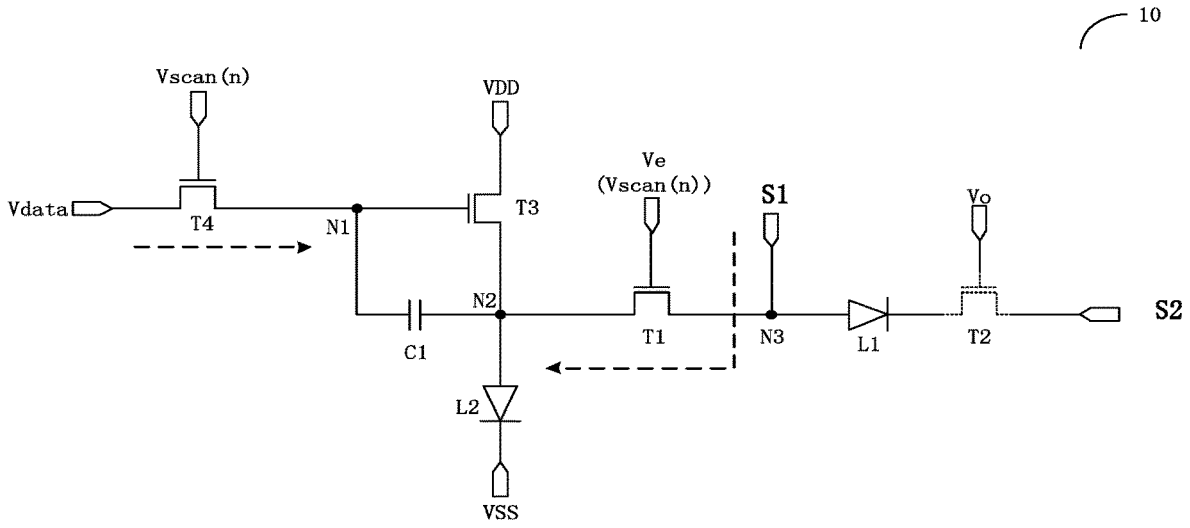
FIGS. 11A to 11C are circuit schematic diagrams of the pixel circuit shown in FIG. 3 corresponding to three phases in FIG. 10.
Figure 11B:
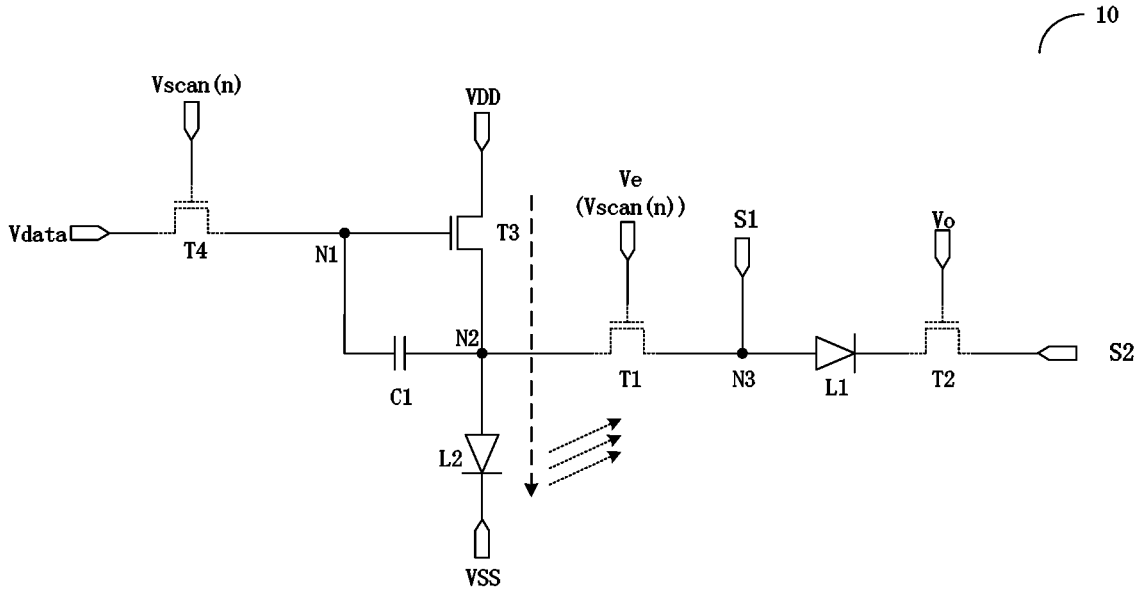
Figure 11C:
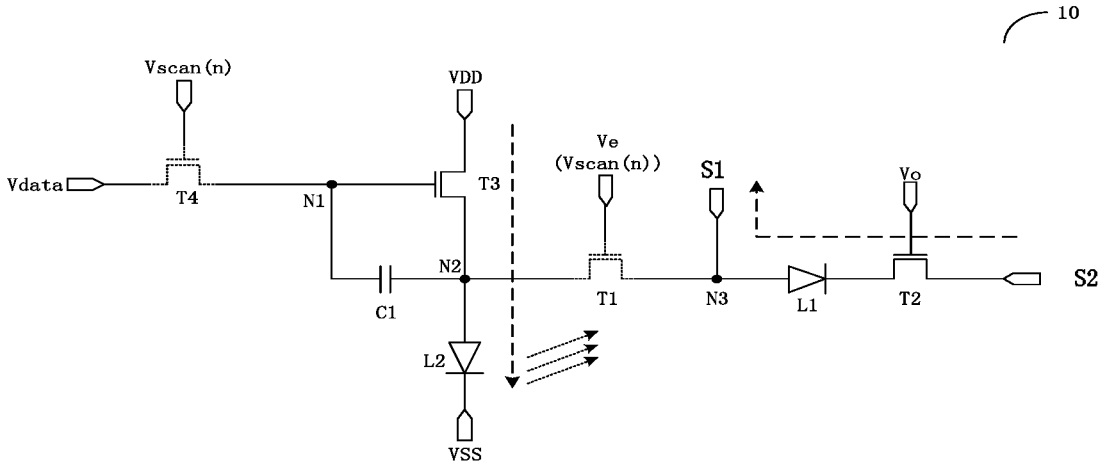

It should be noted that FIG. 11A to FIG. 11C are schematic diagrams of the pixel circuit 10 shown in FIG. 3 in the above-described three phases, respectively. FIG. 11A is a schematic diagram of the pixel circuit 10 shown in FIG. 3 in the display data writing phase 3, FIG. 11B is a schematic diagram of the pixel circuit 10 shown in FIG. 3 in the light emitting phase 4, and FIG. 11C is a schematic diagram of the pixel circuit 10 shown in FIG. 3 in the optical detection phase 5.

In addition, the transistors identified by dashed lines in FIGS. 11A to 11C are in an off state in the corresponding phase, and the dashed lines with arrows in FIGS. 11A to 11C indicate a current direction of the pixel circuit in the corresponding phase. The transistors shown in FIGS. 11A to 11C are all described by taking an N-type transistor as an example, that is, the respective transistors are turned on in a case where the gate electrodes of the respective transistors are connected to a turn-on level (a high level), and the respective transistors are turned off in a case where the gate electrodes of the respective transistors are connected to a turn-off level (a low level). The following embodiments are the same as those described herein and will not be described again.

In the display data writing phase 3, the scanning signal (provided by the scanning signal terminal Vscan(n)) and the data signal (provided by the data signal terminal Vdata) are input to turn on the data writing circuit 200 and the driving circuit 100, the data writing circuit 200 writes the data signal to the driving circuit 100, and the storage circuit 300 stores the data signal. The first detecting terminal S1 provides a second voltage signal to ensure that the storage circuit 300 stores the correct data signal.

As shown in FIG. 10 and FIG. 11A, in the display data writing phase 3, the fourth transistor T4 is turned on by the high level of the scanning signal, the third transistor T3 is turned on by the high level of the first node N1, and the first transistor T1 is turned on by the high level of the electrical detection enable signal (scanning signal); meanwhile, the second transistor T2 is turned off by the low level of the optical detection enable signal.

As shown in FIG. 11A, in the display data writing phase 3, a data writing path is formed (shown by a dashed line with an arrow in FIG. 11A), and the data signal charges the first capacitor C1 after passing through the fourth transistor T4. At this time, the first detecting terminal S1 provides the second voltage signal, that is, the level of the second node N2 is the second voltage, or the first detecting terminal S1 is in a floating state, as long as it can be ensured that the desired data signal can be written into the storage circuit 300 (the first capacitor C1).

After the display data writing phase 3, the voltage information with the data signal is stored in the first capacitor C1, so that the third transistor T3 is controlled to drive the light emitting element L2 to emit light according to the voltage information in the next stage, thereby performing display.

In the light emitting phase 4, the first voltage terminal VDD charges the second node N2 such that the potential of the second node N2 rises, and when the potential of the second node N2 rises up to VSS+Voled, the light emitting element L2 starts to emit light for display. Voled represents a rated operating voltage of the light emitting element L2.

As shown in FIG. 10 and FIG. 11B, in the light emitting phase 4, the third transistor T3 is turned on by the high level of the first node N1; meanwhile, the fourth transistor T4 is turned off by the low level of the scanning signal, the first transistor T1 is turned off by the low level of the electrical detection enable signal (scanning signal), and the second transistor T2 is turned off by the low level of the optical detection enable signal.

As shown in FIG. 11B, in the light emitting phase 4, a driving light emitting path is formed (as indicated by a dashed line with an arrow in FIG. 11B), and because the third transistor T3 is turned on, a driving current can be supplied to the light emitting element L2, and the light emitting element L2 emits light under the action of the driving current.

It should be noted that, in the embodiment, the first voltage terminal VDD charges the second node N2 such that the potential of the second node N2 rises. Due to the bootstrap effect of the first capacitor C1, the potential of the first node N1 rises correspondingly while the potential of the second node N2 rises, thereby ensuring that the voltage difference between the first node N1 and the second node N2 does not change. This method may compensate for the problem of poor uniformity of display brightness caused by the voltage drop (IR Drop) of the second voltage terminal VSS.

In the optical detection phase 5, the optical detection enable signal (provided by the optical detection enable terminal Vo) is input to turn on the optical compensation circuit 600, and the optical compensation circuit 600 generates an electrical signal according to the light emitted from the light emitting element L2 and applies the electrical signal to the second detecting terminal S2, at this time, the first detecting terminal S1 provides the second voltage signal.

As shown in FIG. 10 and FIG. 11C, in the optical detection phase 5, the second transistor T2 is turned on by the high level of the optical detection enable signal, and the third transistor T3 is turned on by the high level of the first node N1; Meanwhile, the fourth transistor T4 is turned off by the low level of the scanning signal, and the first transistor T1 is turned off by the low level of the electrical detection enable signal (scanning signal).

As shown in FIG. 11C, in the optical detection phase 5, a current transmission path (shown by a dashed line with an arrow in FIG. 11C) is formed in the optical compensation circuit 600, and the photoelectric conversion element L1 receives the light emitted from the light emitting element L2 and generates a corresponding electrical signal, the electrical signal is transmitted to the second detecting terminal S2 through the second transistor T2, and is processed by the subsequent detection circuit. At this time, the first detecting terminal S1 supplies the second voltage signal as a bias voltage.

After the optical detection phase 5, the electrical signal generated by the photoelectric conversion element L1 is converted into a digital signal by the subsequent detection circuit (for example, an operational amplifier, an analog-to-digital converter, etc.) and stored, and the signal is further processed by an algorithm to obtain optical compensation data, and then, in the normal light emitting phase of the pixel circuit 10, the optical compensation data processed by the algorithm is superimposed on the input display data to obtain compensated display data, and the compensated display data can be written by the data writing circuit 200 to control the driving circuit 100, so that the brightness difference of the display panel caused by factors such as the difference in threshold voltage and the difference in mobility of the transistor (third transistor T3) in the driving circuit 100 and aging of the OLED can be compensated for. The subsequent detection circuit is not included in the pixel circuit 10, and may be implemented by using a conventional circuit structure, which will not be described in detail herein.

Figure 12:
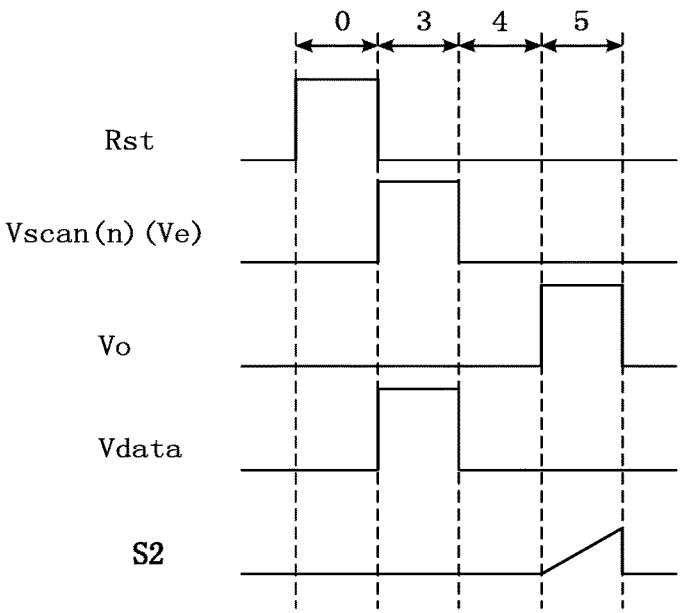
FIG. 12 is a timing diagram of an optical detection step of another pixel circuit provided by an embodiment of the present disclosure.

FIG. 12 is a timing diagram of an optical detection step of another pixel circuit provided by an embodiment of the present disclosure. Referring to FIG. 12, the signal timing is substantially the same as the signal timing shown in FIG. 10 except that a reset phase 0 is also included in the signal timing shown in FIG. 12. The operation principle of the pixel circuit 10 shown in FIG. 6 will be described below with reference to the signal timing diagram shown in FIG. 12. Here, the description will be made by taking a case that each transistor is an N-type transistor as an example, but the embodiment of the present disclosure is not limited thereto.

Figure 13:
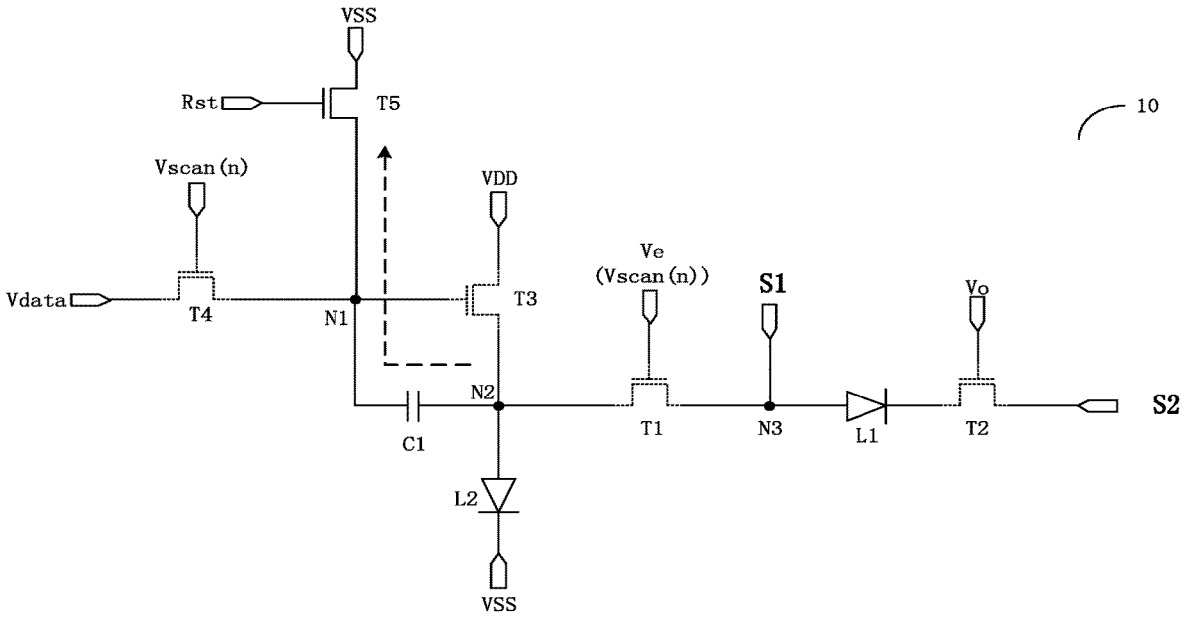
FIG. 13 is a circuit schematic diagram of the pixel circuit shown in FIG. 6 corresponding to a reset phase of FIG. 12.

FIG. 13 is a circuit schematic diagram of the pixel circuit shown in FIG. 6 corresponding to a reset phase shown in FIG. 12. The transistors identified by dashed lines in FIG. 13 are all in an off state during the corresponding phase, and the dashed lines with arrows in FIG. 13 indicates a current direction of the pixel circuit in the corresponding phase. The operation principles of the display data writing phase 3, the light emitting phase 4, and the optical detection phase 5 are substantially the same as those of the pixel circuit 10 shown in FIGS. 10 and 11A to 11C, and are not described herein again.

In the reset phase 0, a reset signal (provided by the reset signal terminal Rst) is input to turn on the reset circuit 700, and the reset circuit 700 applies a reset voltage (provided by the second voltage terminal VSS) to the control terminal 130 of the driving circuit 100 and the first terminal 310 of the storage circuit 300 to reset the driving circuit 100 and the storage circuit 300.

As shown in FIG. 12 and FIG. 13, in the reset phase 0, the fifth transistor T5 is turned on by the high level of the reset signal; meanwhile, the fourth transistor T4 is turned off by the low level of the scanning signal, the third transistor T3 is turned off by the low level of the first node N1, the first transistor T1 is turned off by the low level of the electrical detection enable signal (scanning signal), and the second transistor T2 is turned off by the low level of the optical detection enable signal.

As shown in FIG. 13, in the reset phase 0, a reset path is formed (as indicated by a dashed line with an arrow in FIG. 13), and because the fifth transistor T5 is turned on, the reset voltage can be applied to the gate electrode (first node N1) of the third transistor T3 and the first electrode of the first capacitor C1. Because the reset voltage is a low level signal (e.g., grounded or other low level signal), the first capacitor C1 is discharged through the reset path, thereby resetting the third transistor T3 and the first capacitor C1.

After the reset phase 0, the potential of the first node N1 is the reset voltage. The first capacitor C1 is reset, thereby discharging the charges stored in the first capacitor C1, so that the data signal in the subsequent phase may be stored in the first capacitor C1 more quickly and reliably. Meanwhile, because the third transistor T3 is turned off, the light emitting element L2 is also reset, so that the light emitting element L2 may be displayed in a black state and does not emit light before the display data writing phase 3, so as to improve the display effect such as contrast of the display device using the pixel circuit 10 described above.

It should be noted that the transistors used in the embodiments of the present disclosure may all be thin film transistors, field effect transistors, or other switching devices having the same characteristics. In each embodiment of the present disclosure, a thin film transistor is taken as an example for description. The source electrode and drain electrode of the transistor used here may be symmetrical in structures, so that the source electrode and the drain electrode of the transistor may be indistinguishable in structures. In various embodiments of the present disclosure, in order to distinguish the two electrodes of the transistor other than the gate electrode, one of the two electrodes is directly described as a first electrode and the other is described as a second electrode.

In addition, it should be noted that the transistors in the pixel circuits 10 shown in FIG. 3 and FIG. 6 are all described by taking an N-type transistor as an example. In this case, the first electrode may be a source electrode, and the second electrode may be a drain electrode. The transistors in the pixel circuit 10 may also use only P-type transistors or may use a combination of P-type transistors and N-type transistors, and so long as the port polarities of the selected type of transistors are simultaneously connected in accordance with the port polarities of the corresponding transistors in the embodiments of the present disclosure. When an N-type transistor is used, Indium Gallium Zinc Oxide (IGZO) may be used as an active layer of a thin film transistor, which may effectively reduce the size of the transistor and prevent leakage current compared to use low temperature poly silicon (LTPS) or amorphous silicon (for example, hydrogenation amorphous silicon) as the active layer of the thin film transistor.

At least one embodiment of the present disclosure also provides a display panel including a plurality of pixel units arranged in an array, each of the plurality of pixel units includes the pixel circuit according to any of the embodiments of the present disclosure and a light emitting element. The display panel combines electrical compensation and optical compensation, to compensate for differences in brightness of various regions of the display panel, improve uniformity of display brightness of the display panel and display effect of the display panel, and achieve real-time compensation.

Figure 14:
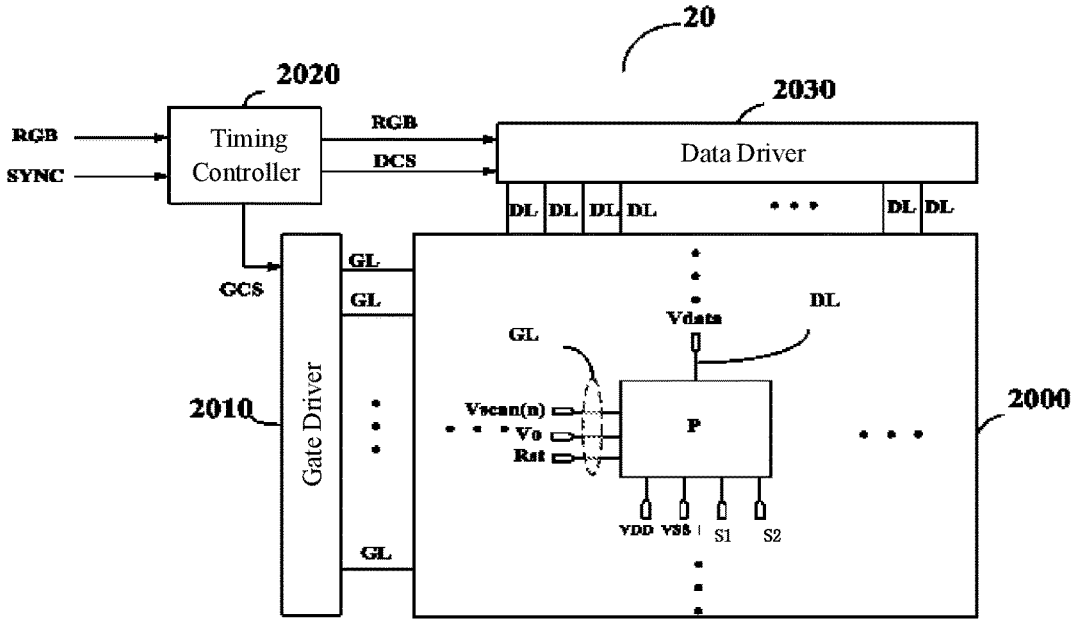
FIG. 14 is a schematic block diagram of a display panel provided by an embodiment of the present disclosure.

FIG. 14 is a schematic block diagram of a display panel provided by an embodiment of the present disclosure. Referring to FIG. 14, a display panel 2000 is disposed in a display device 20 and is electrically connected to a gate driver 2010 and a data driver 2030. The display device 20 also includes a timing controller 2020. The display panel 2000 includes a plurality of pixel units P defined according to a plurality of scan lines GL and a plurality of data lines DL; the gate driver 2010 is used to drive the plurality of scan lines GL; the data driver 2030 is used to drive the plurality of data lines DL; the timing controller 2020 is used to process image data RGB input from the outside of the display device 20, supply the processed image data RGB to the data driver 2030, and output a scan control signal GCS and a data control signal DCS to the gate driver 2010 and the data driver 2030 to control the gate driver 2010 and the data driver 2030.

For example, the display panel 2000 includes the plurality of pixel units P, the pixel unit P comprises the pixel circuit 10 provided by any one of the above embodiments, for example, comprises the pixel circuit 10 as shown in FIG. 3. For example, the pixel unit P may also include the pixel circuit 10 as shown in FIG. 6. As shown in FIG. 14, the display panel 2000 further includes the plurality of scan lines GL and the plurality of data lines DL. For example, the pixel unit P is disposed at an intersection area of a scan line GL and a data line DL. For example, each pixel unit P is connected to three scan lines GL (providing a scanning signal or an electrical detection enable signal, an optical detection enable signal and a reset signal, respectively), a data line DL, a first voltage line for providing a first voltage, a second voltage line for providing a second voltage, a first detection line for providing a first detecting terminal, and a second detection line for providing a second detecting terminal. For example, the first voltage line or the second voltage line may be replaced with a corresponding plate-like common electrode (e.g., a common anode or a common cathode). It should be noted that only a part of the pixel units P, the scan lines GL, and the data lines DL are shown in FIG. 14.

For example, a first terminal of the light emitting element (not shown) is connected to the second terminal 120 of the driving circuit 100, and a second terminal of the light emitting element is connected to the second voltage terminal VSS to receive the second voltage signal, and the light emitting element is configured to emit light according to the driving current.

For example, the gate driver 2010 supplies a plurality of strobe signals to the plurality of scan lines GL according to the plurality of scan control signals GCS derived from the timing controller 2020. The plurality of strobe signals include a scanning signal, an optical detection enable signal, a reset signal, and the like. These signals are supplied to each of the pixel units P through the plurality of scan lines GL.

For example, the data driver 2030 converts the digital image data RGB input from the timing controller 2020 into data signals according to a plurality of data control signals DCS derived from the timing controller 2020 by using reference gamma voltages. The data driver 2030 supplies the converted data signals to the plurality of data lines DL.

For example, the timing controller 2020 processes the image data RGB input from the outside to match the size and resolution of the display panel 2000, and then supplies the processed image data to the data driver 2030. For example, in one example, the timing controller 2020 stores, for example, electrical compensation data and/or optical compensation data, and performs compensation processing on the processed image data to obtain compensated image data, and the compensated image data is then supplied to the data driver 2030. The timing controller 2020 generates the plurality of scan control signals GCS and the plurality of data control signals DCS by using synchronization signals (for example, a dot clock DCLK, a data enable signal DE, a horizontal synchronization signal Hsync, and a vertical synchronization signal Vsync) input from the outside of the display device 20. The timing controller 2020 supplies the generated scan control signals GCS and data control signals DCS to the gate driver 2010 and the data driver 2030, respectively, for control of the gate driver 2010 and the data driver 2030.

For example, the data driver 2030 may be connected to the plurality of data lines DL to provide the data signals, and may also be connected to the plurality of first voltage lines and the plurality of second voltage lines to provide the first voltage and the second voltage, respectively.

For example, the gate driver 2010 and the data driver 2030 may be implemented as a semiconductor chip. The display device 20 may also include other components, such as signal decoding circuits, voltage conversion circuits, etc., these components may be, for example, conventional components, and will not be described in detail herein.

For example, the display panel 2000 may be applied to any product or component having a display function such as an electronic book, a mobile phone, a tablet computer, a television, a display, a notebook computer, a digital photo frame, a navigator, or the like.

Figure 15:
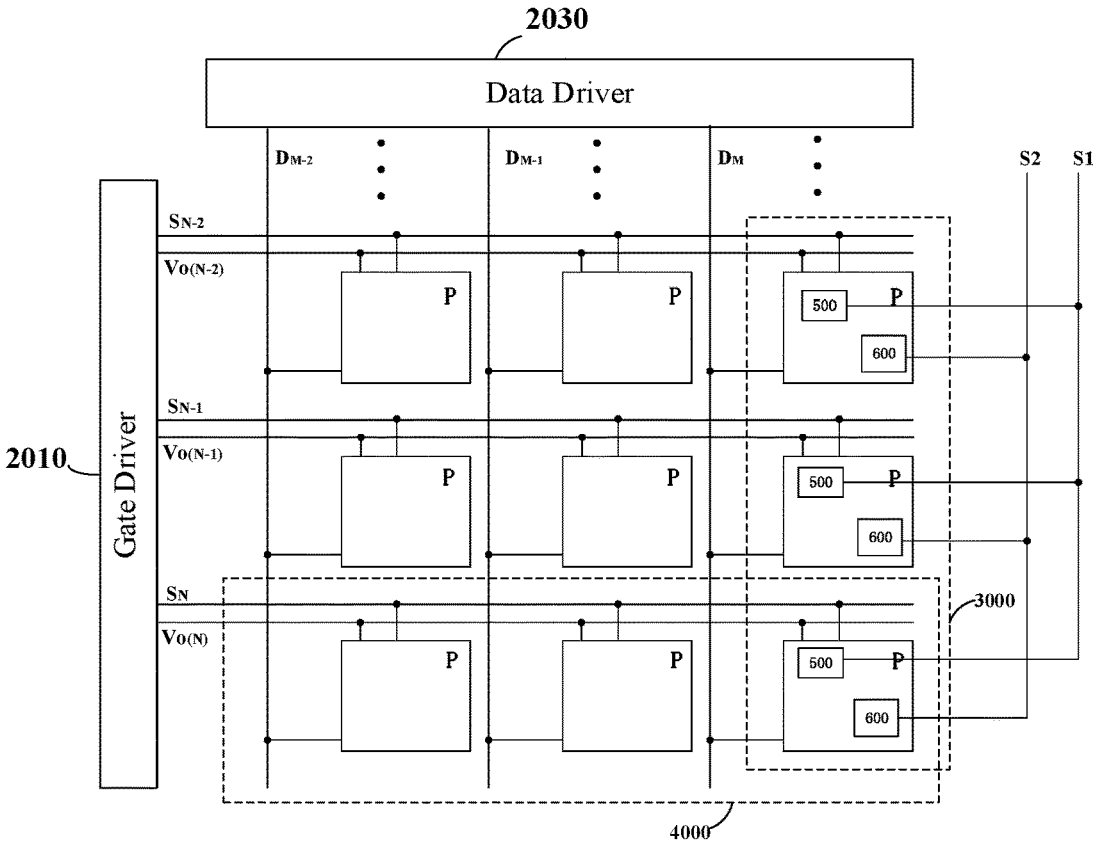
FIG. 15 is a schematic block diagram of another display panel provided by an embodiment of the present disclosure.

FIG. 15 is a schematic block diagram of another display panel provided by an embodiment of the present disclosure. Referring to FIG. 15, a plurality of pixel units P are arranged in a plurality of rows and a plurality of columns, and only a specific connection relationship of the pixel units P in the first example region 3000 and the second example region 4000 is shown in FIG. 15, and the other pixel units P have similar connection relationships.

For example, pixel circuits of pixel units P in the same row are connected to the same signal line to receive the same electrical detection enable signal (scanning signal) and/or optical detection enable signal (as shown in the second example region 4000). For example, first detecting terminals of pixel circuits of pixel units P in the same column are electrically connected to each other, and/or second detecting terminals of the pixel circuits of the pixel units P in the same column are electrically connected to each other (as shown in the first example region 3000). This case simplifies the circuit structure, and the pixel units P of the same row may perform compensation detection at the same time, thereby improving the detection efficiency.

For example, the data line DL in each column (i.e., DM, DM-1, DM-2) is connected to the data writing circuits of pixel circuits in the present column to provide data signals.

At least one embodiment of the present disclosure also provides a driving method of a pixel circuit, and the driving method may be used to drive the pixel circuit 10 provided by an embodiment of the present disclosure. The driving method combines electrical compensation and optical compensation to compensate for differences in brightness of various regions of the display panel, improve uniformity of display brightness of the display panel and display effect of the display panel, and achieve real-time compensation.

For example, in one example, the driving method includes the following operations:

In the electrical detection step, data is written to the driving circuit 100 and the second terminal 120 of the driving circuit 100 is electrically connected to the first detecting terminal S1 by the electrical compensation circuit 500;

In the optical detection step, the optical compensation circuit 600 generates an electrical signal according to the light emitted by the light emitting element L2, and applies the electrical signal to the second detecting terminal S2.

For example, the electrical detection step includes a detection data writing phase and an electrical detection phase. In the detection data writing phase, the scanning signal and the data signal are input to turn on the data writing circuit 200 and the driving circuit 100, the data writing circuit 200 writes the data signal into the driving circuit 100, and the storage circuit 300 stores the data signal, the first detecting terminal S1 provides a second voltage signal; in the electrical detection phase, an electrical detection enable signal is input to turn on the electrical compensation circuit 500, and the electrical compensation circuit 500 electrically connects the second terminal 120 of the driving circuit 100 to the first detecting terminal S1, and the first detecting terminal S1 is in a floating state.

For example, in the case where the electrical detection enable signal and the scanning signal are the same signal, the electrical detection phase further includes inputting a scanning signal and a data signal to turn on the data writing circuit 200 and the driving circuit 100, the data writing circuit 200 writing the data signal to the driving circuit 100, and the storage circuit 300 storing the data signal.

For example, the optical detection step includes an optical detection phase. In the optical detection phase, the optical detection enable signal is input to turn on the optical compensation circuit 600, the optical compensation circuit 600 generates the electrical signal according to the light emitted by the light emitting element L2 and applies the electrical signal to the second detecting terminal S2, and the first detecting terminal S1 provides a second voltage signal.

For example, the electrical detection step is performed during a blanking time of a scanning timing.

It should be noted that, in various embodiments of the present disclosure, the manner in which the electrical detection step and the optical detection step are combined with each other is not limited, and may be determined according to actual needs. For example, in one example, because the aging degree of the OLED is relatively small in a short time, the main change in the short time is the characteristics of the transistor, so that the electrical detection step is performed once every display time of N image frame, N is an integer greater than 0, and the optical detection step is performed before each shutdown. Thus, the next time the power is turned on, the result of the electrical compensation and the result of the optical compensation may be utilized, thereby improving the uniformity of the display brightness of the display device. This method can save system resources. For example, in another example, a display time may be preset such that the optical detection step is performed at a preset display time, and the electrical detection step is performed once every display time of N image frame, and N is an integer greater than zero. Thus, from the next frame image, the result of the electrical compensation and the result of the optical compensation may be utilized, thereby improving the uniformity of the display brightness of the display device. In this way, the performing frequency of the electrical detection step and the optical detection step may be flexibly adjusted according to the display requirements to meet diverse needs.

It should be noted that, for a detailed description of the driving method, reference may be made to the description of the operation principle of the pixel circuit 10 in the embodiments of the present disclosure, and details are not described herein again.

The following statements should be noted:

(1) The accompanying drawings involve only the structure(s) in connection with the embodiment(s) of the present disclosure, and other structure(s) can be referred to common design(s).

(2) In case of no conflict, the embodiments of the present disclosure and features in the embodiment(s) can be combined with each other to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A pixel circuit comprising a driving circuit, a data writing circuit, a storage circuit, an electrical compensation circuit, and an optical compensation circuit, wherein the driving circuit comprises a control terminal, a first terminal and a second terminal, and is configured to control a driving current for driving a light emitting element to emit light, the first terminal of the driving circuit is configured to receive a first voltage signal from a first voltage terminal;

the data writing circuit is connected to the control terminal of the driving circuit, and is configured to write a data signal into the control terminal of the driving circuit in response to a scanning signal;

the storage circuit is configured to store the data signal written by the data writing circuit, a first terminal of the storage circuit is connected to the control terminal of the driving circuit, and a second terminal of the storage circuit is connected to the second terminal of the driving circuit;

the electrical compensation circuit is connected to the second terminal of the driving circuit and a first detecting terminal, and is configured to electrically connect the second terminal of the driving circuit to the first detecting terminal in response to an electrical detection enable signal to obtain a current flowing through the second terminal of the driving circuit to compensate the data signal according to the current; and the optical compensation circuit is connected to a reverse bias voltage terminal and a second detecting terminal, and is configured to detect light emitted by the light emitting element in response to an optical detection enable signal, and apply an electrical signal, which is generated according to the light emitted by the light emitting element, to the second detecting terminal to compensate the data signal according to the electrical signal, the first detecting terminal is multiplexed into the reverse bias voltage terminal.

2. The pixel circuit according to claim 1, wherein the electrical compensation circuit comprises a first transistor;

a gate electrode of the first transistor is configured to be connected to an electrical detection enable line to receive the electrical detection enable signal, a first electrode of the first transistor is configured to be connected to the second terminal of the driving circuit, and a second electrode of the first transistor is configured to be connected to the first detecting terminal.

3. The pixel circuit according to claim 1, wherein the data writing circuit is connected to a scan line to receive the scanning signal, and the electrical compensation circuit is connected to the scan line to receive the scanning signal, wherein the scanning signal serves as the electrical detection enable signal.

4. The pixel circuit according to claim 1, wherein the optical compensation circuit comprises a photoelectric conversion element and a second transistor;

a first terminal of the photoelectric conversion element is configured to be connected to the reverse bias voltage terminal to receive a reverse bias voltage signal, and a second terminal of the photoelectric conversion element is configured to be connected to a first electrode of the second transistor; and a gate electrode of the second transistor is configured to be connected to an optical detection enable line to receive the optical detection enable signal, and a second electrode of the second transistor is configured to be connected to the second detecting terminal.

5. The pixel circuit according to claim 1, wherein the driving circuit comprises a third transistor;

a gate electrode of the third transistor serves as the control terminal of the driving circuit, a first electrode of the third transistor serves as the first terminal of the driving circuit, and a second electrode of the third transistor serves as the second terminal of the driving circuit.

6. The pixel circuit according to claim 1, wherein the data writing circuit comprises a fourth transistor;

a gate electrode of the fourth transistor is configured to be connected to a scan line to receive the scanning signal, a first electrode of the fourth transistor is configured to be connected to a data line to receive the data signal, and a second electrode of the fourth transistor is configured to be connected to the control terminal of the driving circuit.

7. The pixel circuit according to claim 1, further comprising a reset circuit, wherein the reset circuit is connected to the control terminal of the driving circuit, and is configured to apply a reset voltage to the control terminal of the driving circuit in response to a reset signal.

8. The pixel circuit according to claim 7, wherein the reset circuit comprises a fifth transistor;

a gate electrode of the fifth transistor is configured to be connected to a reset line to receive the reset signal, a first electrode of the fifth transistor is configured to be connected to the control terminal of the driving circuit, and a second electrode of the fifth transistor is configured to be connected to a second voltage terminal to receive the reset voltage.

9. A display panel comprising a plurality of pixel units arranged in an array, each of the plurality of pixel units comprising a pixel circuit and a light emitting element, wherein the pixel circuit comprises a driving circuit, a data writing circuit, a storage circuit, an electrical compensation circuit, and an optical compensation circuit, the driving circuit comprises a control terminal, a first terminal and a second terminal, and is configured to control a driving current for driving the light emitting element to emit light, the first terminal of the driving circuit is configured to receive a first voltage signal from a first voltage terminal;

the data writing circuit is connected to the control terminal of the driving circuit, and is configured to write a data signal into the control terminal of the driving circuit in response to a scanning signal;

the storage circuit is configured to store the data signal written by the data writing circuit, a first terminal of the storage circuit is connected to the control terminal of the driving circuit, and a second terminal of the storage circuit is connected to the second terminal of the driving circuit;

the electrical compensation circuit is connected to the second terminal of the driving circuit and a first detecting terminal, and is configured to electrically connect the second terminal of the driving circuit to the first detecting terminal in response to an electrical detection enable signal to obtain a current flowing through the second terminal of the driving circuit to compensate the data signal according to the current; and the optical compensation circuit is connected to a reverse bias voltage terminal and a second detecting terminal, and is configured to detect light emitted by the light emitting element in response to an optical detection enable signal, and apply an electrical signal, which is generated according to the light emitted by the light emitting element, to the second detecting terminal to compensate the data signal according to the electrical signal, the first detecting terminal is multiplexed into the reverse bias voltage terminal.

10. The display panel according to claim 9, wherein the plurality of pixel units are arranged in a plurality of rows and a plurality of columns, pixel circuits of pixel units in a same row are connected to a same signal line to receive a same electrical detection enable signal and/or a same optical detection enable signal.

11. The display panel according to claim 9, wherein the plurality of pixel units are arranged in a plurality of rows and a plurality of columns, first detecting terminals of pixel circuits of pixel units in a same column are electrically connected to each other, and/or second detecting terminals of pixel circuits of pixel units in a same column are electrically connected to each other.

12. The display panel according to claim 9, wherein a first terminal of the light emitting element is connected to the second terminal of the driving circuit, a second terminal of the light emitting element is configured to receive a second voltage signal of a second voltage terminal, and the light emitting element is configured to emit light according to the driving current.

13. A driving method of a pixel circuit, wherein the pixel circuit comprises a driving circuit, a data writing circuit, a storage circuit, an electrical compensation circuit, and an optical compensation circuit, the driving circuit comprises a control terminal, a first terminal and a second terminal, and is configured to control a driving current for driving a light emitting element to emit light, the first terminal of the driving circuit is configured to receive a first voltage signal from a first voltage terminal;

the data writing circuit is connected to the control terminal of the driving circuit, and is configured to write a data signal into the control terminal of the driving circuit in response to a scanning signal;

the storage circuit is configured to store the data signal written by the data writing circuit, a first terminal of the storage circuit is connected to the control terminal of the driving circuit, and a second terminal of the storage circuit is connected to the second terminal of the driving circuit;

the electrical compensation circuit is connected to the second terminal of the driving circuit and a first detecting terminal, and is configured to electrically connect the second terminal of the driving circuit to the first detecting terminal in response to an electrical detection enable signal to obtain a current flowing through the second terminal of the driving circuit to compensate the data signal according to the current; and the optical compensation circuit is connected to a reverse bias voltage terminal and a second detecting terminal, and is configured to detect light emitted by the light emitting element in response to an optical detection enable signal, and apply an electrical signal, which is generated according to the light emitted by the light emitting element, to the second detecting terminal to compensate the data signal according to the electrical signal, the first detecting terminal is multiplexed into the reverse bias voltage terminal, the driving method comprises an electrical detection step and an optical detection step;

wherein in the electrical detection step, writing data into the driving circuit, and electrically connecting the second terminal of the driving circuit to the first detecting terminal by the electrical compensation circuit;

in the optical detection step, the optical compensation circuit generating the electrical signal according to the light emitted by the light emitting element, and applying the electrical signal to the second detecting terminal.

14. The driving method of the pixel circuit according to claim 13, wherein the electrical detection step comprises a detection data writing phase and an electrical detection phase;

in the detection data writing phase, the scanning signal and the data signal are input to turn on the data writing circuit and the driving circuit, the data writing circuit writes the data signal into the driving circuit, the storage circuit stores the data signal, and the first detecting terminal provides a second voltage signal;

in the electrical detection phase, the electrical detection enable signal is input to turn on the electrical compensation circuit, and the electrical compensation circuit electrically connects the second terminal of the driving circuit to the first detecting terminal, and the first detecting terminal is in a floating state.

15. The driving method of the pixel circuit according to claim 14, wherein in a case where the electrical detection enable signal and the scanning signal are a same signal, the electrical detection phase further comprises:

inputting the scanning signal and the data signal to turn on the data writing circuit and the driving circuit, writing the data signal into the driving circuit by the data writing circuit, and storing the data signal by the storage circuit.

16. The driving method of the pixel circuit according to claim 13, wherein the optical detection step comprises an optical detection phase;

in the optical detection phase, the optical detection enable signal is input to turn on the optical compensation circuit, the optical compensation circuit generates the electrical signal according to the light emitted by the light emitting element and applies the electrical signal to the second detecting terminal, and the first detecting terminal provides a second voltage signal.

17. The driving method of the pixel circuit according to claim 13, wherein the electrical detection step is performed during a blanking time of a scanning timing.

18. The driving method of the pixel circuit according to claim 17, wherein the electrical detection step is performed once every display time of N image frame, the optical detection step is performed before each shutdown, and N is an integer greater than zero.

19. The driving method of the pixel circuit according to claim 17, wherein the electrical detection step is performed once every display time of N image frame, the optical detection step is performed at a preset display time, and N is an integer greater than zero.

* * * * *